US006020687A

United States Patent [19]

Hirakawa et al.

[11] Patent Number: 6,020,687

[45] Date of Patent: Feb. 1, 2000

[54] METHOD FOR DRIVING A PLASMA DISPLAY PANEL

[75] Inventors: Hitoshi Hirakawa; Nobuyoshi Kondo; Akira Otsuka; Takashi Katayama, all of Kawasaki; Seiki Kurogi, Satsuma; Hiroyuki Nakahara, Kawasaki, all of Japan

[73] Assignee: Fujitsu Limited, Kawasaki, Japan

[21] Appl. No.: 09/039,243

[22] Filed: Mar. 16, 1998

[30] Foreign Application Priority Data

Mar. 18, 1997 [JP] Japan ..... 9-065094
Aug. 29, 1997 [JP] Japan ..... 9-233561

[51] Int. Cl.[7] ..... G09G 3/28

[52] U.S. Cl. ..... 315/169.1; 315/169.2; 345/37; 345/60

[58] Field of Search ..... 315/169.4, 169.3, 315/169.2, 169.1; 345/60, 63, 55, 61, 66, 68, 41, 37

[56] References Cited

U.S. PATENT DOCUMENTS 5,854,540 12/1998 Matsumoto et al. ..... 315/169.1
5,877,734 3/1999 Amemiya ..... 345/60

FOREIGN PATENT DOCUMENTS 0 157 248 10/1985 European Pat. Off. .
0 431 471 6/1991 European Pat. Off. .
0 657 861 6/1995 European Pat. Off. .
0 680 087 11/1995 European Pat. Off. .
60-196797 10/1985 Japan .
61-39341 2/1986 Japan .
7-160218 6/1995 Japan .
8-101665 4/1996 Japan .

OTHER PUBLICATIONS

Patent Abstracts of Japan, No. 08101664, Apr. 16, 1996.

*Primary Examiner*—Don Wong
*Assistant Examiner*—Wilson Lee
*Attorney, Agent, or Firm*—Staas & Halsey

[57] ABSTRACT

A method for driving a plasma display panel includes carrying out an erase address operation when a display on the screen is renewed. The erase address operation includes the steps of carrying out an address preparation operation for producing the wall charge in all the discharge cells through a first step of generating a discharge only in a discharge cell in an ON-state and a second step of generating a discharge only in a discharge cell in an OFF-state, and carrying out an operation for selectively erasing the wall charge in a discharge cell other than a discharge cell corresponding to data of the image to be displayed.

32 Claims, 20 Drawing Sheets

METHOD FOR DRIVING A PLASMA DISPLAY PANEL

CROSS-REFERENCES TO RELATED APPLICATIONS

This application is related to Japanese applications Nos. HEI 9(1997)-065094 and HEI 9(1997)-233561, filed on Mar. 18, 1997 and Aug. 29, 1997 whose priorities are claimed under 35 USC §119, the disclosures of which are incorporated by reference in their entirety.

BACKGROUND OF THE INVENTION

1. Field of the Invention

The present invention relates to a method for driving plasma display panels (PDPs) which are used as display terminals for television sets and computers.

2. Description of Related Art

In recent years, the PDPs have been attracting much attention as large-sized flat displays capable of TV display in full color as their upsizing and adaptation to color display have been in progress. The PDPs are thought to be potential wall-mountable TV displays. For realizing such large-sized wall-mountable television displays, the PDPs are required to be further upsized, to provide images with higher definition, and also to exhibit a long-term stability in operation.

In general, AC-driven and DC-driven PDPs are known. The AC-driven PDPs are poorer in contrast and gradation compared with the DC-driven PDPs. However, the AC-driven PDPs have the advantages of a simpler structure, ability to generate images with higher definition, higher luminance and so on.

The PDPs are also classified into a surface discharge type and an opposition discharge type on the basis of the structure of electrodes. In the opposition discharge PDPs, a layer of a fluorescent material is formed directly on a discharge surface. For this reason, the opposition discharge PDPs have some disadvantages: They lack stability in operation; the fluorescent layer deteriorates in a short time due to ion impact during discharges and thereby the luminance drops, and the like. In the surface discharge type PDPs which are intended to eliminate these problems, electrodes for generating surface discharges are formed on a substrate and a fluorescent layer is formed on another substrate whereby the deterioration of the fluorescent layer can be prevented and a stable discharge characteristic can be obtained.

Among such PDPs, a surface discharge PDP having three kinds of electrodes is known as a typical AC-driven surface discharge PDP. The conventional PDP is now explained with the three-electrode surface discharge PDP as an example.

The three-electrode AC surface discharge PDP includes a panel having two glass substrates between which pixels, which are also referred to as "cells" or "discharge cells," are arranged in matrix. The pixel is defined by a pair of parallel sustain electrodes, which are also referred to as "display electrodes" or "main electrodes," covered with a dielectric layer and an address electrode, which is also referred to as a "select electrode" intersecting the sustain electrodes.

For driving the three-electrode AC surface discharge PDP, a time period for displaying one image is separated into an address period and a sustain period. This time period for display one image is referred to as a frame, a field if a frame consists of a plurality of fields, or a sub-field if a field consists of a plurality of sub-fields, and here referred to simply as a sub-field. The address period and the sustain period are each synchronous all over a screen. In the address period, an address discharge is generated to produce wall charge only on the sustain electrodes of specific cells. In the sustain period, a sustain discharge which is also referred to as display discharge is generated across the sustain electrodes on which the wall charge have been produced. In the address period, cells are selected by the address discharge across the select electrode and one of the sustain electrodes, and in the sustain period, the sustain discharge is generated across the sustain electrodes in the selected cells to display an image.

In such driving of the PDP, the addressing of specific cells is performed by a write address method or by an erase address method.

In the write address method, all cells on a screen are reset, that is, a "0" is written, at the beginning of each sub-field, then the address discharge is carried out only in selected cells, i.e., display cells, in the address period, and then the sustain discharge is carried out in the selected cells in the sustain period. In other words, at the beginning of each sub-field, all cells are initialized so that residual charge therein are reduced to zero. (To put it more precisely, a reset operation is performed to light all the cells to produce charge and then immediately erase the built-up charge.) Then the address discharge is generated only in the selected cells to produce wall charge therein, and then in the sustain period, the wall charge in the selected cells is maintained. This address discharge is called write address discharge.

On the other hand, in the erase address method, all cells are made to emit light, that is, a "1" is written, at the beginning of each sub-field, then the address discharge is carried out only in non-selected cells, i.e., cells not to be lighted for display, in the address period, and then the sustain discharge is generated in the selected cells in the sustain period. In other words, at the beginning of each sub-field, the wall charge is produced in all the cells, then the wall charge only in the non-selected cells is removed by the address discharge, which is called an erase address discharge, and then in the sustain period, the wall charge of the selected cells is maintained.

A three-electrode AC surface discharge PDP using the write address method is disclosed in Japanese Unexamined Patent Publication No. HEI 7(1995)-160218.

Three-electrode AC surface discharge PDPs using the erase address method are disclosed in Japanese Unexamined Patent Publication Nos. SHO 60(1985)-196797, SHO 61(1986)-39341, and HEI 8(1996)-101665.

In the above-described write address method, the residual charge produced in the sustain period of the immediately preceding sub-field is initialized and then the write address discharge is carried out. Accordingly, a priming effect of discharge cannot be utilized, and therefore a high writing voltage is required. Further, since the probability of discharge drops, a writing pulse must be lengthened. For this reason, there is a limit to high-speed drive for high-definition display. Further, a driver of high voltage resistance is needed, which raises production costs.

On the other hand, in the erase address method, since all the cells are made to emit light at the beginning of each sub-field, the contrast is somewhat poorer compared with the write address method. However, as merits outweighing this disadvantage, it is known that the priming effect of the wall charge can be utilized. Therefore, the address period can be shortened and a high-speed drive can be realized.

However, practical-use PDPs using the erase address method have not been positively developed so far for the following reasons. Even though a uniform voltage is applied to all the sustain electrodes, the discharge easily occurs in some cells, and hardly occurs in other cells. Due to such various voltage characteristics of the cells, it is difficult to produce wall charge uniformly in all the cells. Also the cells varies in thermal characteristics in producing the wall charge.

SUMMARY OF THE INVENTION

An object of the present invention is to provide a method for driving a PDP employing the erase address method including producing uniform wall charge in all cells before the address discharge by optimizing the production of charge and thereby enable a high-speed, stable drive.

Another object of the present invention is to improve the reliability of the initialization to charge an entire screen uniformly.

Still another object of the present invention is to prevent mis-lighting in the sustain period and thereby can realize high-quality display free of flicker.

The inventors of the present invention have focused attention on the erase address method utilizing the priming effect of space charge and wall charge positively, in order to cope with the defects of the write address method. Though the erase address method has conventionally been side-stepped because it cannot produce wall charge uniformly in the cells of a panel which are different in discharge characteristics, the present invention has succeeded in producing uniform wall charge in the cells-by utilizing a self-erase discharge or gently curved waveforms in consideration of balances among the electrodes of the three-electrode surface discharge PDP. By use of the space charge and wall charge, the present invention provides a method for driving a PDP employing the erase addressing, according to which the PDP can be driven stably at a high speed and at low voltages.

The present invention provides a method for driving a plasma display panel provided with a screen for displaying an image, the screen including a plurality of discharge cells having a memory function by means of wall charge, which comprises carrying out an erase address operation according to data of an image to be displayed when a display on the screen is renewed, wherein the erase address operation comprises the steps of carrying out an address preparation operation for producing the wall charge in all the discharge cells through a first step of generating a discharge only in a discharge cell in an ON-state in which a discharge is sustained on the screen before the renewal, so as to reverse the polarity of wall charge therein, and a second step of generating a discharge only in a discharge cell in an OFF-state which is other than the ON-state discharge cell, so as to produce wall charge of the same polarity as that in the ON-state discharge cell; and carrying out an operation for selectively erasing the wall charge in a discharge cell other than a discharge cell corresponding to the data of the image to be displayed.

According to the present invention, uniform charge can be produced in all pixels composing a screen or a block within a screen, and then the charge can be removed from pixels which are not necessary for display by a erase address discharge. Therefore, in the address discharge, the priming effect of the charge can positively be utilized and thereby a stable drive at low voltages can be realized. In addition to that, time necessary for the address discharge can be reduced and as a result, a high-speed drive can be realized.

DESCRIPTION OF THE PREFERRED EMBODIMENTS

Figure 1:
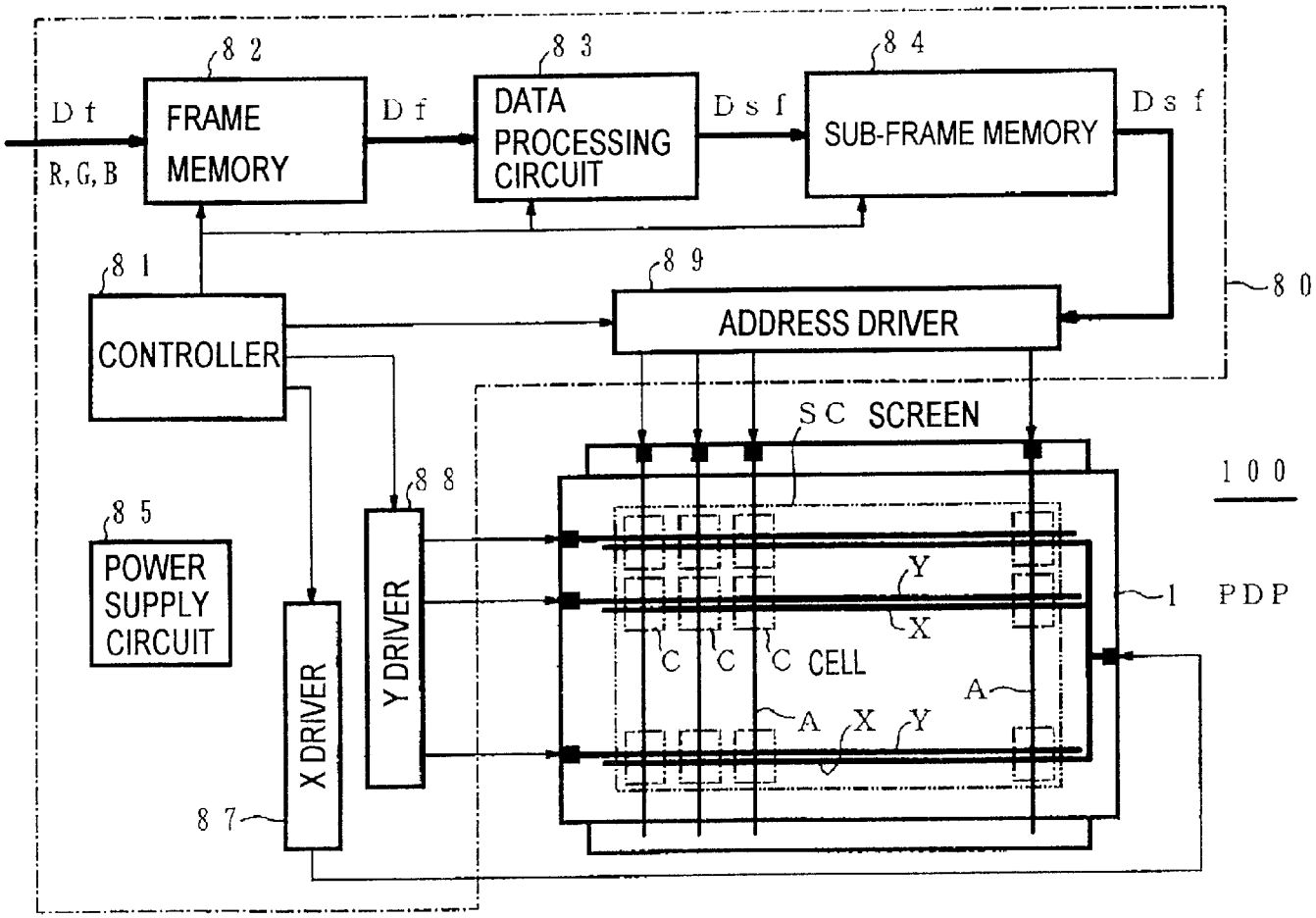
FIG. 1 is a diagram illustrating the structure of a plasma display in accordance with the present invention.

In the present invention, an electrically conductive transparent film may be used for the sustain electrodes. For the address electrodes, an electrically conductive metal film such as Cr/Cu/Cr may be used.

In the first step of generating a discharge only in the ON-state discharge cell, a voltage higher than a sustain voltage for sustaining a discharge may be applied to all the discharge cells.

In this case, the voltage applied in the first step may be a step-wave voltage pulse whose crest value increases stepwise from the sustain voltage.

In the second step of generating a discharge only in the OFF-state discharge cell, a voltage capable of generating a discharge whose crest value is higher than the sustain voltage may be applied to all the discharge cells.

In this case, the voltage applied in the second step may be a step-wave voltage pulse whose crest value increases stepwise.

The voltage applied in the second step may be a voltage pulse of gently curved waveform whose crest value increases gradually.

The voltage applied in the second step may be a voltage having a crest value about twice as high as that of the sustain voltage.

The above-described method may further comprise, after the second step, a third step of generating a self-erase discharge in the OFF-state discharge cell and, before the self-erase discharge finishes, applying a voltage for producing the wall charge to all the discharge cells thereby to stop the self-erase discharge and re-produce the wall charge.

In this case, after the voltage for producing the wall charge is applied in the third step, the voltage may be gradually reduced.

The method of the invention may further comprise, prior to the first step, applying to all the discharge cells a voltage as high as the sustain voltage thereby to generate a discharge in the ON-state discharge cell.

In another aspect of the present invention, there is provided a method for driving a plasma display panel provided with a screen for displaying an image, the screen including a plurality of discharge cells having a memory function by means of wall charge, which comprises carrying out an address operation on all the discharge cells on the screen for selectively producing the wall charge for the memory function to write data of an image on the screen; and carrying out an sustain operation on all the discharge cells on the screen for generating a discharge in discharge cells in which the wall charge is produced so as to display the image, wherein the address operation comprises the steps of: carrying out an address preparation operation for producing the wall charge in all the discharge cells through a first step of generating a discharge only in a discharge cell in an ON-state in which a discharge is sustained on the screen before the writing of the data of the image so as to reverse the polarity of the wall charge therein and a second step of generating a discharge only in a discharge cell in an OFF-state in which a discharge is not sustained before the writing of the data of the image so as to produce the wall charge of the same polarity as that in the ON-state discharge cell; and carrying out an operation for selectively erasing the wall charge in a discharge cell other than a discharge cell corresponding to the data of the image to be displayed.

In this case, in the sustain operation, a first sustain voltage pulse may be periodically applied to all the discharge cells and subsequently a second sustain voltage pulse higher than the first sustain voltage pulse may be applied a certain number of times before the sustaining of the discharge is finished.

In the sustain operation, a sustain voltage pulse of rectangular waveform for sustaining a discharge may be periodically applied to all the discharge cells and subsequently a sustain voltage pulse of gently curved waveform whose voltage shifts gradually at the trailing edge thereof may be applied a certain number of times before the sustaining of the discharge is finished. 14. In the sustain operation, the sustain voltage may be periodically applied to all the discharge cells and a state in which the sustain voltage is applied last may be maintained until the first step of the address operation.

In the sustain operation, the sustain voltage may be periodically applied to all the discharge cells and the pulse width of a certain number of sustain voltage pulses applied in an opening stage of the sustain operation may be shorter than that of other sustain voltage pulses. In this case, the certain number may be one, two or three.

In the sustain operation, the sustain voltage may be periodically applied to all the discharge cells and the crest value of a certain number of sustain voltage pulses applied in an opening stage of the sustain operation may be lower than that of other sustain voltage pulses. In this case, the certain number may be one, two or three.

In still another aspect of the present invention, there is provided a method for driving a plasma display panel provided with a plurality of discharge cells arranged in matrix each having a memory function by means of wall charge, so as to write data of a picture in the plasma display panel, which comprises: an address preparation step for producing the wall charge in all discharge cells used for displaying a picture (all discharge cells on an entire screen or a part of a screen which is used for displaying a picture); and an address step for erasing the produced wall charge in a non-selected discharge cell which need not be lighted, wherein the address preparation step comprises a first step of generating a discharge only in a discharge cell in an ON-state in which a discharge is sustained before the writing of data of the picture, so as to reverse the polarity of wall charge therein, and a second step of generating a discharge only in a discharge cell in an OFF-state in which a discharge is not sustained before the writing of the data of the picture, so as to produce wall charge of the same polarity as that in the ON-state discharge cell.

In this case, the plasma display panel may comprise a plurality of pairs of parallel sustain electrodes covered with a dielectric layer which correspond to a plurality of display rows and a plurality of address electrodes extending in a direction intersecting the pairs of sustain electrodes, the pairs of sustain electrodes and the address electrodes being opposedly arranged with a discharge space therebetween and defining the plurality of discharge cells arranged in matrix at intersections of the pairs of sustain electrodes and the address electrodes.

In this case, the first step may comprise application to the pairs of sustain electrodes of all the discharge cells used for displaying the picture of a voltage higher than the sustain voltage.

The voltage applied in the first step may be a step-wave voltage pulse whose crest value increases stepwise from the sustain voltage.

The second step may comprise application to the pairs of sustain electrodes of such voltages of positive polarity and of negative polarity that make an effective voltage capable of generating a discharge.

In this case, the voltage of positive polarity may be a step-wave voltage pulse whose crest value increases stepwise.

The voltage of positive polarity may be a voltage pulse of gently curved waveform whose crest value increases gradually.

The second step may comprise application to one of the pair of sustain electrodes of a voltage about twice as high as the sustain voltage.

The above-described method may further comprise, after the second step, a third step of reducing the potentials of the pairs of sustain electrodes to zero to generate an self-erase discharge in the OFF-state discharge cell and, before the self-erase discharge finishes, applying to one of the pair of sustain electrodes a voltage for producing the wall charge thereby to stop the self-erase discharge and re-produce the wall charge.

In this case, after the voltage for producing the wall charge is applied in the third step, the voltage may be gradually reduced.

In the second step, only the voltage of positive polarity may be gradually reduced to zero after being applied.

In the second step, only the voltage of negative polarity may be gradually reduced to zero after being applied.

In the second step, the voltages of positive polarity and of negative polarity may be gradually reduced to zero after being applied.

In the above-described method, in the address step, a voltage is applied to one of the pair of sustain electrodes which is used as a scan electrode, the voltage having a polarity opposite to that of the wall charge produced in the address preparation step, thereby to prevent a discharge in a half-selected cell.

The present invention is now described in further detail by way of example thereof by reference to the accompanying drawings, which should not be construed to limit the scope of the invention.

FIRST EMBODIMENT

FIG. 1 a diagram illustrating the structure of a plasma display 100 in accordance with the present invention.

The plasma display 100 includes an AC-driven PDP 1 which is a color display device of matrix system and a drive unit 80 for selectively lighting a large number of cells (i.e., discharge cells) C composing a screen SC. The plasma display 100 can be used as a wall-mountable television display or a monitor of a computer system.

The PDP 1 is a three-electrode surface discharge PDP in which pairs of sustain electrodes X and Y are disposed in parallel as the first and second main electrodes and define cells as display elements at intersections with address electrodes A as the third electrodes. The sustain electrodes X and Y extend in the direction of rows, i.e., in a horizontal direction, on the screen. The sustain electrodes Y are used as scanning electrodes for selecting cells row by row in addressing. The address electrodes A extend in the direction of columns, i.e., in a vertical direction, on the screen and are used as data electrodes for selecting cells column by column in the addressing. An area where the sustain electrodes intersect the address electrodes is a display area, that is, a screen.

The drive unit 80 includes a controller 81, a frame memory 82, a data processing circuit 83, a sub-frame memory 84, a power supply circuit 85, an X driver 87, a Y driver 88 and an address driver 89. To the drive unit 80, frame data Df representative of luminance levels, i.e., gradation levels, of individual colors R, G and B for each pixel is inputted from external devices such as a computer, a TV tuner or the like together with various kinds of synchronizing signals.

The frame data Df are stored in the frame memory 82 and then transferred to the data processing circuit 83. The data processing circuit 83 is a data converter for setting combinations of sub-frames in which cells are to emit light and outputs sub-frame data Dsf in accordance with the frame data Df. The sub-frame data Dsf are stored in the sub-frame memory 84. Each bit of the sub-frame data has a value representing whether or not a cell must emit light in a sub-frame.

The X driver circuit 87 applies a driving voltage to the sustain electrodes X, and the Y driver circuit 88 applies a driving voltage to the sustain electrodes Y. The address driver circuit 89 applies a driving voltage to the address electrodes A according to the sub-frame data Dsf. To these driver circuits, the power supply circuit 85 supplies electric power.

Figure 2:
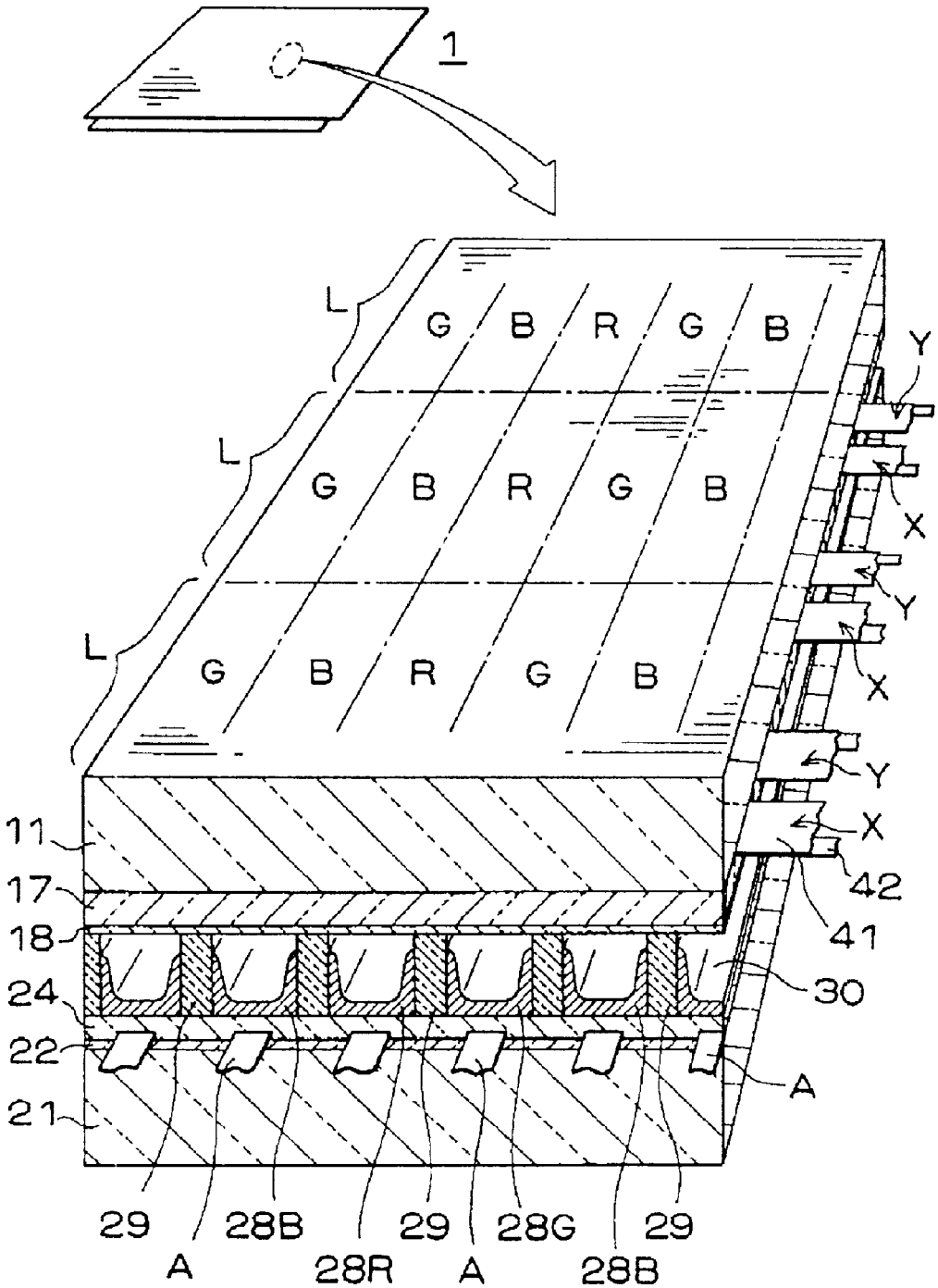
FIG. 2 is a perspective view illustrating the inner construction of a PDP.

FIG. 2 is a perspective view illustrating the inner construction of the PDP 1.

In the PDP 1, a pair of sustain electrodes X and Y is disposed on each row L which is a line of cells in the horizontal direction on the matrix screen, on an inside surface of a front glass substrate 11. The sustain electrodes X and Y are main electrodes for performing display and each include an electrically conductive transparent film 41 and a metal film (bus conductor) 42 and is covered with a dielectric layer 17 of a low-melting glass of 30 $\mu$m thickness. A protection film 18 of magnesia (MgO) of several thousand Å thickness is formed on a surface of the dielectric layer 17. The address electrode A is disposed on a base layer 22 covering an inside surface of a rear glass substrate 21. The address electrode A is covered with a dielectric layer 24 of about 10 $\mu$m thickness. On the dielectric layer 24, ribs 29 of about 150 $\mu$m height are each disposed between the address electrodes A. The ribs 29 are in the form of a linear band in a plan view. These ribs 29 partition a discharge space 30 into sub-pixels (light-emitting units) in the row direction and also define a spacing for the discharge space 30. Fluorescent layers 28R, 28G and 28B of three colors R, G and B for color display are formed to cover walls on a rear substrate side including surfaces above the address electrodes A and side walls of the ribs 29. The fluorescent layers are arranged in a stripe pattern such that cells on the same column emit light of the same color and cells on adjacent columns emit light of different colors.

The ribs are preferably colored dark on top portions and white in the other portions to reflect visible light well for improving contrast. The ribs can be colored by adding pigments of intended colors to a material glass paste.

The discharge space 30 is filled with a discharge gas of neon as the main component with which xenon is mixed (the pressure in the panel is 500 Torr). The fluorescent layers 28R, 28G and 28B are locally excited to emit light by ultraviolet rays irradiated by xenon when an electric discharge takes place. One pixel for display is composed of three sub-pixels adjacently placed in the row direction. The sub-pixels in each of the columns emit light of the same color. The structural unit of each sub-pixel is a cell C (a display element). Since the ribs 29 are arranged in a stripe pattern, portions of the discharge space 3 which correspond to the individual columns are vertically continuous, bridging all the rows. For this reason, the gap between the electrodes in adjacent rows (referred to as a reverse slit) is set to be sufficiently larger than a gap to allow a surface discharge in each of the rows (e.g., 80 to 140 $\mu$m), in order to prevent coupling by an electric discharge in the column direction, for example, about 400 to 500 $\mu$m. Additionally, for the purpose of covering whitish fluorescent layers in the reverse slits, which do not emit light, light-tight films are provided on the outer or inner surface of the glass substrate 11 corresponding to the reverse slits.

Figure 3:
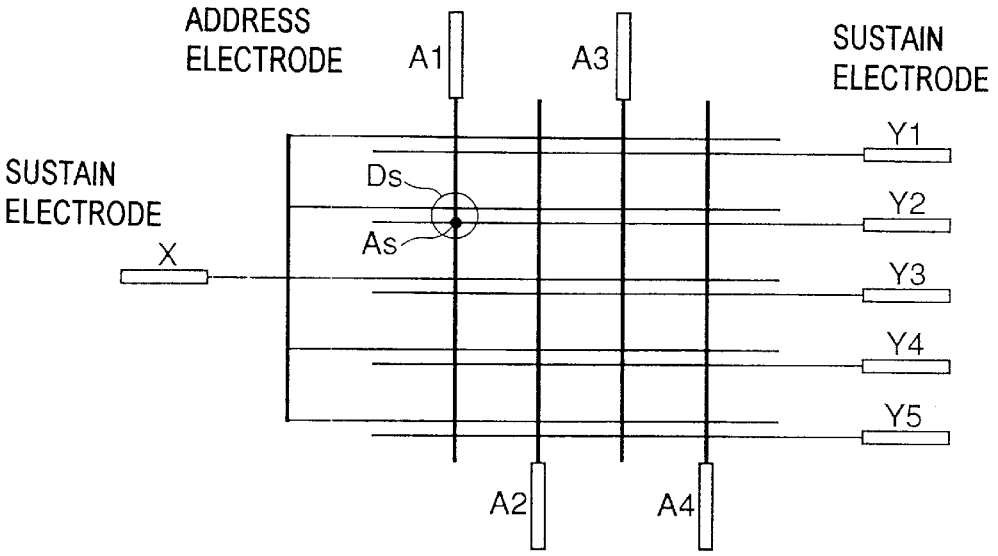
FIG. 3 is a diagram explaining an exemplary arrangement of electrodes of the three-electrode AC surface discharge PDP.

FIG. 3 is a diagram explaining an arrangement of electrodes of the above-described three-electrode AC surface discharge PDP for color display.

As shown in the figure, in the three-electrode AC surface discharge PDP, three kinds of electrodes, i.e., a pair of sustain electrodes X and Yn, wherein n is a positive integer and which is also referred to simply as sustain electrode Y, and an address electrode An, wherein n is a positive integer and which is also referred to simply as address electrode A, perpendicularly intersecting the sustain electrodes, are provided for each sub-pixel. One sustain electrode Yn and the address electrode A define an address discharge cell As at their intersection, and an sustain discharge cell Ds is defined between the sustain electrodes X and Y.

Of the sustain electrodes X and Y used for sustain discharges, the sustain electrodes X are driven by a central driver connected commonly to all the sustain electrodes X. The other sustain electrodes Y are used as scanning electrodes for writing data as well as for sustain discharge. The address electrodes A are used only for address discharges for writing data.

At the addressing, the address discharge is generated in the address discharge cell defined by one selected scanning electrode, i.e., sustain electrode Y, and an address electrode A. To the address electrode A, a discharge current only for one cell is applied at one time. Voltage at this time is determined by combination with voltage applied to the scanning electrode.

With the three-electrode AC surface discharge PDP, high gradation display of eight bits can be performed by a driving method for gradation (gray-scale) display known as an ADS (Address and Sustain period Separated) sub-field method.

Figure 4:
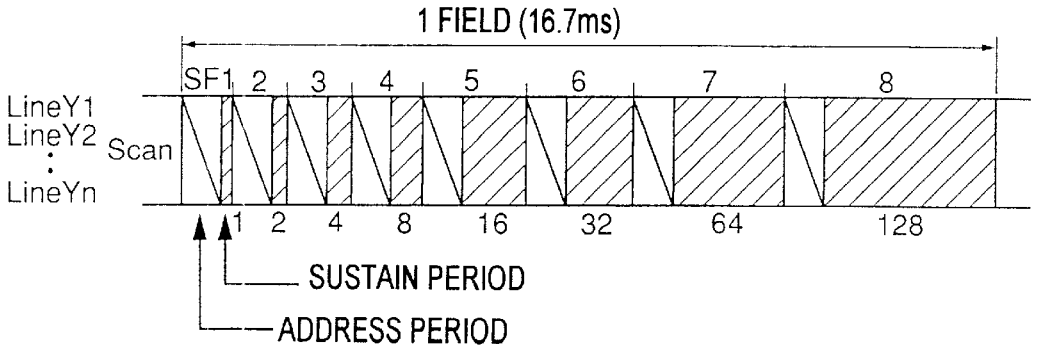
FIG. 4 illustrates an ADS sub-field method.

FIG. 4 explains the ADS sub-field method.

As shown in the figure, for driving by this gradation driving method, one field is divided into a plurality of sub-fields and each of the sub-fields is further divided into an address period and a sustain period.

In an NTSC system usually used for TV display and the like, 30 frames of images are formed for a second. With interlacingly scanning every two rows, one frame is composed of two fields. As a result, 60 fields of images are formed for a second.

In the ADS sub-field method, one second is composed of 60 fields (1 field=16.7 ms). Further, one field is divided into eight sub-fields, SF1 to SF8, each of which is provided with the address period and the sustain period for carrying out the address discharge and the sustain discharge, respectively. The number of discharges in the display cell defined by the sustain electrodes X and Y is set such that the relative ratio of luminance by the sustain discharge in the sub-fields is 1:2:4:8:16:32:64:128, for example.

The voltage applied across the sustain electrode Y and the address electrode A in the address period and the voltage applied across the sustain electrodes X and Y in the sustain period are both voltages of rectangular waveform i.e., pulse voltages. The above-mentioned number of discharges across the sustain electrodes X and Y means the number of sustain pulses.

Thus, the lighting or non-lighting in each sub-field is controlled according to data of display luminance so as to realize a high gradation display having 256 levels of luminance by combining the eight sub-fields.

In this gradation driving method, the sub-fields are each divided into the address period and the sustain period which are common in terms of time all over the screen. Since the erase address method is used here, the following driving is performed.

An initialization period is provided at the beginning of the address period. In this initialization period, predetermined wall charge is produced in all the cells composing the screen. For this purpose, the wall charge of cells which have been lighted in the immediately preceding sub-field (precedingly selected cells in which the sustain discharge has been carried out, i.e., cells in an ON-state) is maintained, and the wall charge is newly produced only in cells which have not been lighted in the immediately preceding sub-field (precedingly non-selected cells in which the sustain discharge has not been carried out, i.e., cells in an OFF-state).

Then in the address period, scanning is performed row by row, according to display data, to generate the address discharge only in non-selected cells not to emit light for display so that the wall charge produced in the non-selected cells are erased.

Then in the sustain period, the sustain pulse is applied to all the cells on the screen to sustain discharges (referred to also as sustain discharges) for display in the selected cells in which the wall charge has been produced. For the sustain discharge, the same sustain pulse as used in the conventional write address method can be used except at the first sustain discharge.

According to the above-described erase address method, the width of the pulse applied in the address period can be reduced. Thus, it is possible to drive the PDP with an address pulse having an extremely short width of 1.5 $\mu$s per row.

Thus, in the erase address method, the wall charge must be uniformly produced all over the screen at the beginning of each sub-field. Ideal wall charge is thought to be the one that is produced above both the sustain electrodes X and Y by the sustain discharge.

For this reason, in this erase address method, residual charge in cells lighted in the preceding sub-field is positively utilized. That is, as described above, the wall charge in cells in which the sustain discharge has been performed in the preceding sub-field are maintained as it is, and the new wall charge is produced only in the precedingly non-lighted cells.

That is, the uniform wall charge is produced in all the cells composing the screen in the initialization period, and then the address discharge is created only in the non-selected cells in the erase address period. By this address discharge, the wall charge produced in the non-selected cells is removed. As a result, the sustain discharge cannot take place in the non-selected cells in the sustain period.

Figure 5:
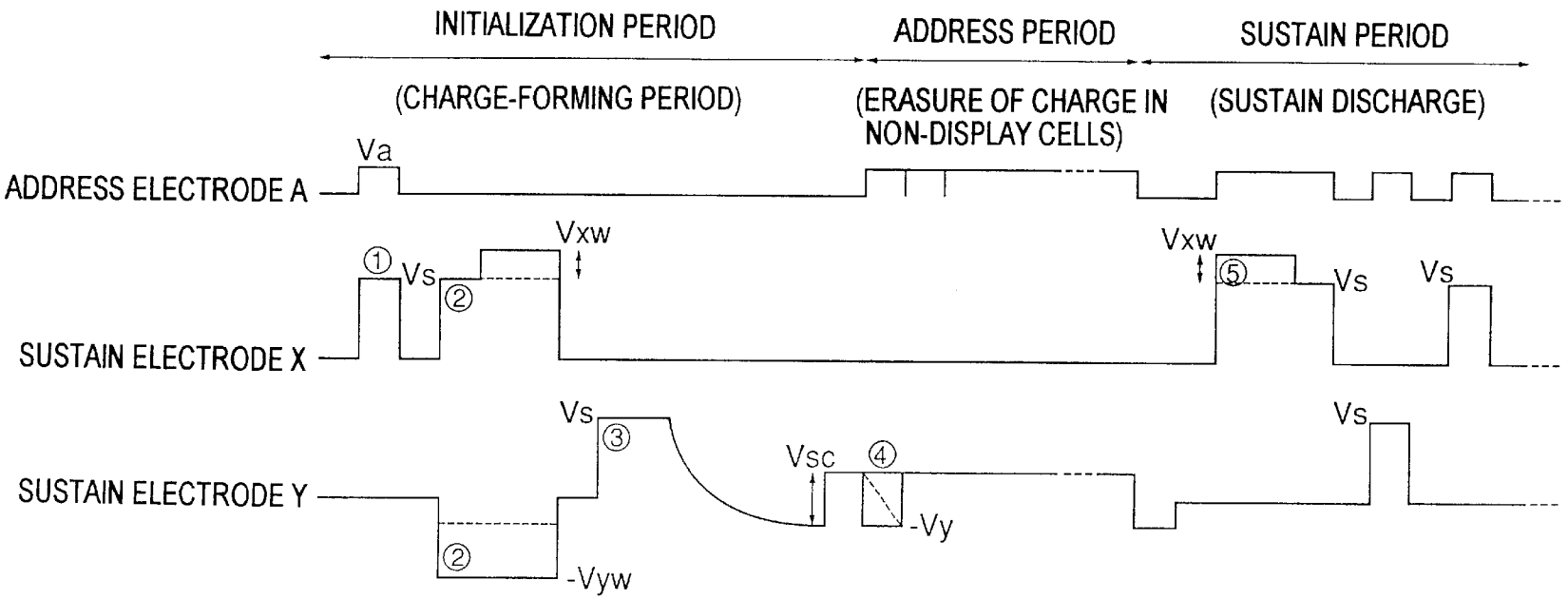
FIG. 5 illustrates exemplary waveforms of voltage pulses applied to electrodes by the erase address method.
Figure 6:
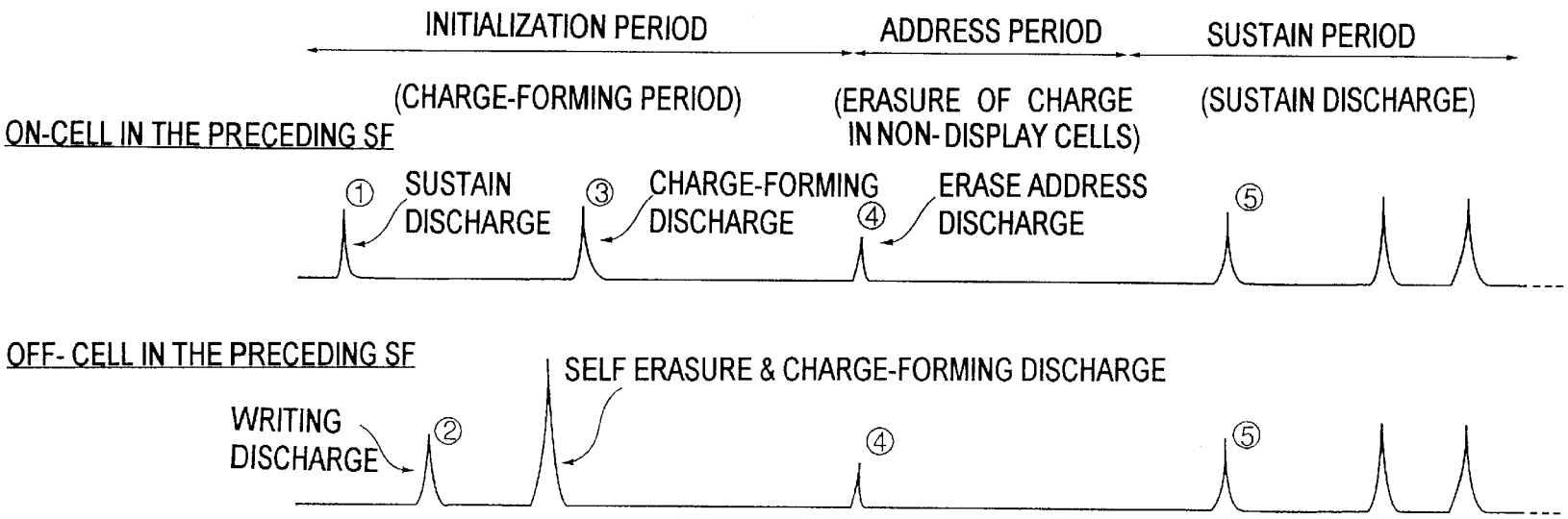
FIG. 6 illustrates light-emission pulses when voltage pulses are applied and the timing thereof.
Figure 7:
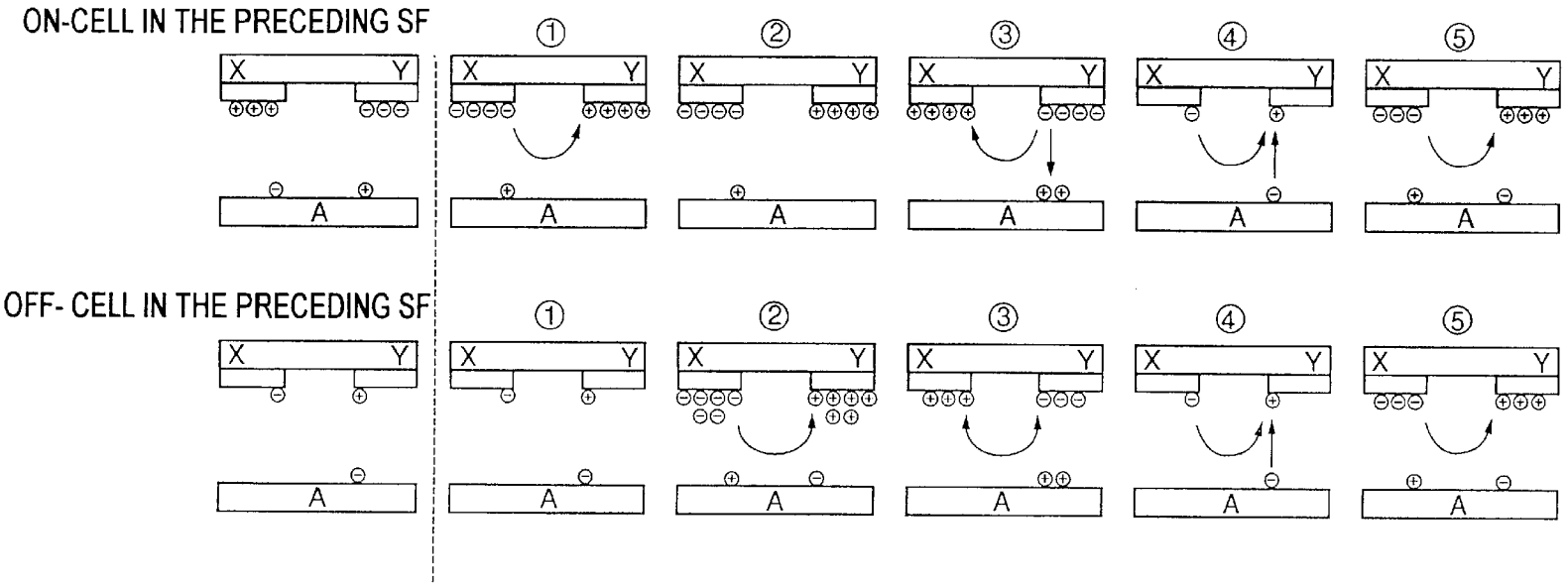
FIG. 7 illustrates models of electric charge when voltage pulses are applied.

FIG. 5 shows exemplary waveforms of voltage pulses applied to the electrodes by the erase address method. FIG. 6 shows light-emission pulses and the timing thereof when the voltage pluses are applied. FIG. 7 shows charge models when the voltage pulses are applied.

With reference to these figures, explained are the waveforms of the voltages applied to the address electrode A and the sustain electrodes X and Y in each of the initialization period (referred also as address preparation period), the address period and the sustain period (display period).

Explanation about the precedingly selected cell and the precedingly non-selected cell in each stage is more easily understood by referring to the charge models showing the wall charge on the address electrode and the sustain electrodes X and Y in FIG. 7.

The voltages of the applied pulses are as follows:

Va: 50 to 140 V, preferably 60 V

Vs: 150 to 190 V, preferably 170 V

Vxw: 10 to 50 V, preferably 15 V

Vy: 40 to 120 V, preferably 60 V

Vyw: 150 to 190 V, preferably 170 V (Vxw=Vs)

Vsc: 0 to 80 V, preferably 60 V

Initialization (Charge-producing) Period

① Application of a pulse for reversing charge (a pulse ① in the figure)

This pulse for reversing charge (charge-reversing pulse) has a low voltage just enough to generate a discharge in cells selected in the preceding sub-field and is applied to reverse the polarity of the wall charge of said cells so that, when a pulse for writing discharge is applied later, the writing discharge is generated (new wall charge is produced) only in cells not selected in the preceding sub-field.

The width of the charge-reversing pulse is longer than the width of the sustain pulse for sustain discharge (display discharge) so as to produce a large amount of wall charge. The width is within the range of 3 to 12 μs, preferably 8 μs. The crest value of the charge-reversing pulse is preferably the same as or higher than that of the sustain pulse.

At this stage, in order to prevent a discharge across the sustain electrode X and the address electrode A, a voltage pulse of crest value Va is applied to the address electrode A. The width of this voltage pulse Va is desirably the same as or higher than that of the charge-reversing pulse.

Cells selected in the preceding sub-field: since the charge-reversing pulse applied to the sustain electrodes X is basically the sustain pulse, only the cells having had the sustain discharge in the preceding sub-field can start a discharge.

Cells not selected in the preceding sub-field: since the cells not selected in the preceding sub-field does not have the wall charge, the effective voltage in the cell is lower than a firing voltage Vfxy1. As a result, the discharge cannot take place in these cells.

② Application of pulses for writing (pulses ② in the figures)

Pulses for writing discharge (writing pulses) are applied for generating the writing discharge in the cell not selected in the preceding sub-field so as to produce new wall charge therein. The writing pulses of positive polarity and of negative polarity are applied to the sustain electrode X and Y, respectively. The width of the writing pulses is 4 μs or more for raising discharge probability, preferably within the range of 8 to 16 μs. In this embodiment, the width of the pulses is set to 12 μs. The crest values of the writing pulses are preferably almost the same as that of the sustain pulse in absolute value. However, so long as a potential difference between the sustain electrodes X and Y is about double the sustain pulse, the crest values may vary in a positive and a negative direction.

In order to ensure the discharge in cells having a low discharge probability without affecting the discharge intensity in normal cells, a voltage Vxw of about 10 to 50 V is additionally applied to one of the sustain electrodes X and Y about 1 μs after the building-up of the writing pulses. In this embodiment, 15 V was additionally applied to the sustain electrode X.

When the writing pulses are applied, the address electrode A is grounded to prevent a discharge across the address electrode A and the sustain electrodes X and Y.

Immediately after the application of the writing pulses, the three electrodes, i.e., the sustain electrodes X and Y and the address electrode A, are all grounded to generate a self-erase discharge.

The cells selected in the preceding sub-field: since the wall charge of the polarity opposite to the writing pulses are produced in these cells by the charge-reversing pulses in the preceding step, the wall voltage cancels the applied voltage of the writing pulses and therefore the discharge does not take place.

The cells not selected in the preceding sub-field: since the effective voltage (Vs+Vyw) in these cells becomes higher than Vfxy1, the discharge starts. In this case, as described above, considering that normal cells complete the discharge within 1 μs after the building-up of the writing pulses, 15 V is additionally applied only to the sustain electrode X about 1 μs after the rise of the writing pulses to raise the applied voltage to Vxw so that all cells can start the discharge. Thus, the discharge probability of cells which have not discharged for some reasons is raised without affecting the discharge intensity of the normal cells. In addition, the width of the pulses is lengthened so that the wall charge is produced in a large amount and the writing discharge is ensured even if the discharge probability drops due to low temperatures or the like.

③ Application of a pulse for producing wall charge (a pulse ③ in the figures)

Before this step, the wall charge has been produced in the cells selected in the preceding sub-field by the charge-reversing pulses and in the cells not selected in the preceding sub-field by the writing pulses. As a result, the wall charge produced in the cells selected in the preceding sub-field and that produced in the cells not selected in the preceding sub-field are the same in polarity, but are different in amount (the cells not selected in the preceding sub-field have a larger amount of wall charge).

Accordingly, this pulse for producing wall charge (charge forming pulse) is applied so that the cells selected in the preceding sub-field have the same amount of wall charge as the cells not selected in the preceding sub-field and thereby all the cells have a uniform amount of wall charge.

In this step, within 1.0 μs, preferably 0.5 to 0.8 μs, after the completion of the writing discharge in the preceding step, including the time for grounding all the three electrodes, a voltage pulse is raised at the sustain electrode Y (scanning electrode) which is one of the sustain electrodes used for the erase address discharge, so as to stop the self-erase discharge and draw space charge in the discharge space to produce wall charge. Accordingly, a discharge takes place again in the cells selected in the preceding sub-field and the wall charge is produced.

The width of the charge-producing pulse is preferably 3 μs or more, particularly 4 to 12 μs, so that the wall charge is certainly produced. The crest value of the charge-producing pulse is preferably the same as or higher than the crest value Vs of the sustain pulse.

The charge-producing pulse has a gently curved waveform in order to produce an appropriate amount of wall charge. More particularly, the crest value is gradually reduced from Vs to −Vy in 40 to 120 μs, preferably in 80 μs at the trailing edge of the voltage pulse. When the charge-producing pulse is applied, the address electrode A is grounded.

The cells selected in the preceding sub-field: since the voltage pulse of the same polarity as that of the wall charge in these cells is applied, a discharge takes place again. However, in order that the wall charge is also produced on the dielectric layer on the address electrodes A, the address electrode A is grounded to first generate a priming discharge across the sustain electrode Y and the address electrode A and then generate a discharge across the sustain electrodes Y and X. Thus, charge of positive polarity is produced on the address electrode A. On the dielectric layer on the sustain electrodes X and Y, uniform wall charge is produced.

The cell not selected in the preceding sub-field: The charge-producing pulse is raised about 0.8 μs after the application of the writing pulse in the preceding step. When the application of the writing pulse is completed and all the three electrodes are grounded, the wall charge produced by the writing discharge starts the self-erase discharge. However, since the charge-producing pulse is raised in such a timing that the self-erase discharge does not completely finish, the self-erase discharge is forced to stop, and thereby a large amount of space charge is left in the discharge space. This space charge is drawn onto the dielectric layers on the electrodes by the charge-producing pulse, to produce wall charge. Thus, by the method in which the self-erase discharge of the large amount of wall charge produced by the writing discharge is generated thereby to erase excess charge and then the wall charge is re-produced, the wall charge is uniformly produced above the sustain electrodes X and Y.

Erase Address Period (erase address discharge: removing charge from non-selected cells)

④ Application of a pulse for an erase address discharge (a pulse ④ in the figures)

The pulse for the erase address discharge (a voltage pulse synthesized from an address pulse applied to the address electrode and an scan pulse applied to the scan electrode(one of the sustain electrodes used for scanning)) is applied to create an address discharge only in non-selected cells to remove the stored wall charge. Thereby, the sustain discharge does not occur later in these cells.

Before the application of the erase pulse for the address discharge, the wall charge of the same polarities as that of the erase pulse for the address discharge is produced on the dielectric layer on all the sustain electrodes X and Y and the address electrode A. Accordingly, when the erase pulse for the address discharge is applied, the applied voltage is added to the wall voltage. Therefore, the voltage of the erase pulse for the address discharge can be reduced. Also the priming effect of the wall charge can thus be utilized, and new wall charge does not need to be produced. Therefore, compared with the write address method, pulses of reduced width can be used for the address discharge. In the erase address period, a voltage Vsc of the polarity opposite to the polarity of the build-up wall charge is applied to the sustain electrodes used as the scan electrodes. Thereby a mis-discharge is prevented from occurring in a half-selected cell (a discharge cell to which either the address pulse or the scan pulse is applied).

Sustain Period (sustain discharge)

⑤ Application of a pulse for the sustain discharge (a pulse ⑤ in the figures)

Cells which have not had the erase address discharge have sufficient wall charge for creating the sustain discharge (display discharge). Therefore, there cells can smoothly proceed to the sustain discharge. As the pulse for the sustain discharge (display pulse), a voltage pulse of crest value Vs is applied. The width of the display pulse may be 1 to 12 μs, preferably 3 μs.

At the application of the display pulse, space charge may sometimes fly in due to the erasing discharge or the like in adjacent cells. In order to compensate the amount of wall charge which is lost by recoupling of the flying-in space charge, a voltage of crest value Vs plus 10 to 40 V is applied for the first sustain discharge. The width of this first display pulse is preferably 4 to 16 μs.

Figure 8:
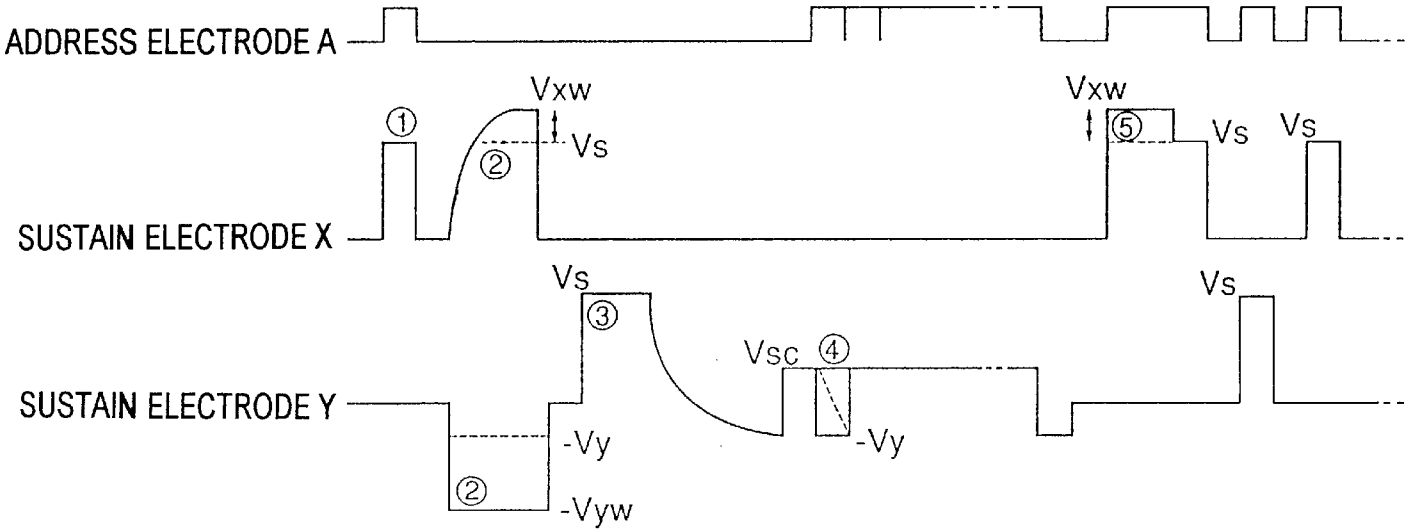
FIG. 8 illustrates another example of waveforms of applied voltage pulses in the case of a writing pulse of gently curved waveform.
Figure 9:
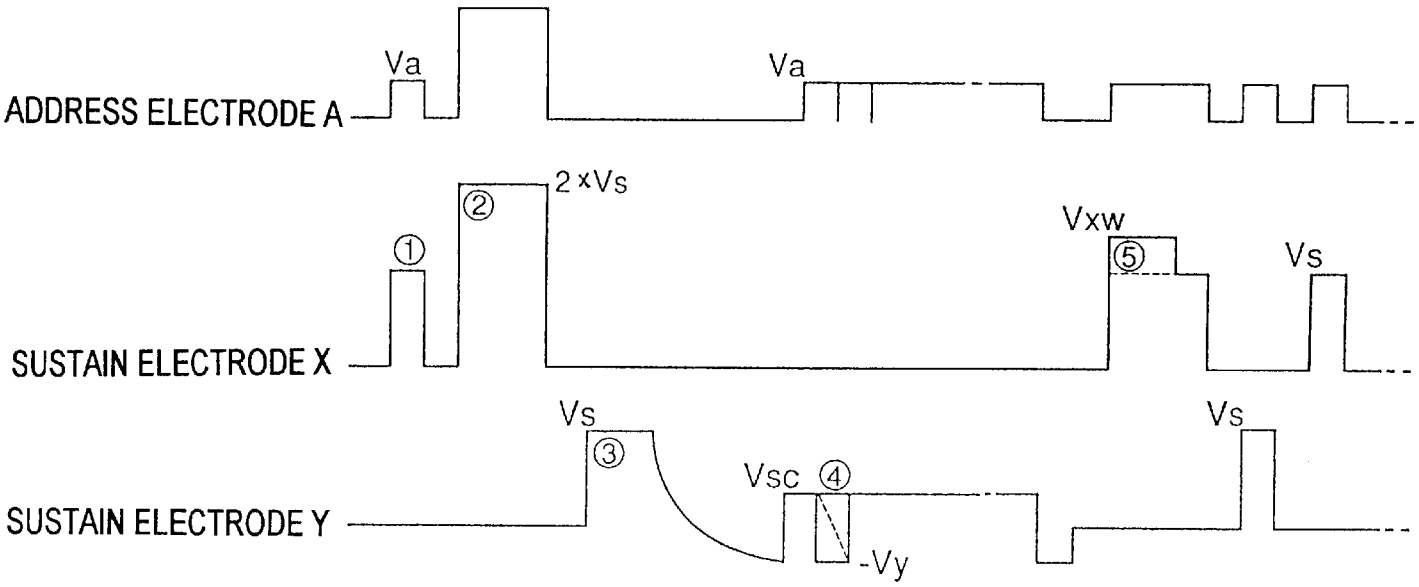
FIG. 9 illustrates another example of waveforms of voltage pulses in the case where only pulses of positive polarity are applied as writing pulses.

FIGS. 8 and 9 illustrate alternative examples of writing pulses.

As for the writing pulses (the pulse ② in the figures) applied in the initialization period, the voltage of about 10 to 50 V, preferably 15 V, is additionally applied to one of the sustain electrodes X and Y about 1 μs after the building-up of the pulse, in the above described embodiment. However, in this alternative example shown in FIG. 8, a gently curved waveform is adopted in order to reduce discharge intensity.

If one of the writing pulses has a gently curved waveform, a cell which easily discharges starts a discharge just at the firing voltage. Thus, the discharge intensity is reduced and this contributes to improvement in contrast because the intensity of light involved with the discharge, which has no relation with light emitted by the display discharge, is decreased. In this embodiment, only the sustain electrode X receives a pulse of gently curved waveform. However, the sustain electrode Y or both the sustain electrodes X and Y may receive a pulse of gently curved waveform.

Further, as for the writing pulses applied in the initialization period, the voltage pulses of positive polarity and negative polarity are applied to the sustain electrodes X and Y, respectively, in the foregoing embodiment. However, as described above, the crest values in the positive and negative directions may vary so long as the potential difference across the sustain electrodes X and Y is about double the sustain pulse. For example, a voltage pulse of the same polarity as that of the charge-reversing pulse and of crest value twice as high as the crest value Vs of the sustain pulse may be applied only on the sustain electrode X, as shown in FIG. 9.

Thus, instead of using writing pulses of positive and negative polarities with complicated waveforms, the sustain electrode Y may be grounded and a voltage pulse equivalent to 2×Vs may be applied only to the sustain electrode X. However, in the case where such a voltage pulse having a crest value of 2×Vs is applied, a voltage pulse of 50 to 180 V of the same polarity as that of the writing pulse is applied to the address electrode A in order to prevent a discharge across the sustain electrode X and the address electrode A.

Figure 10:
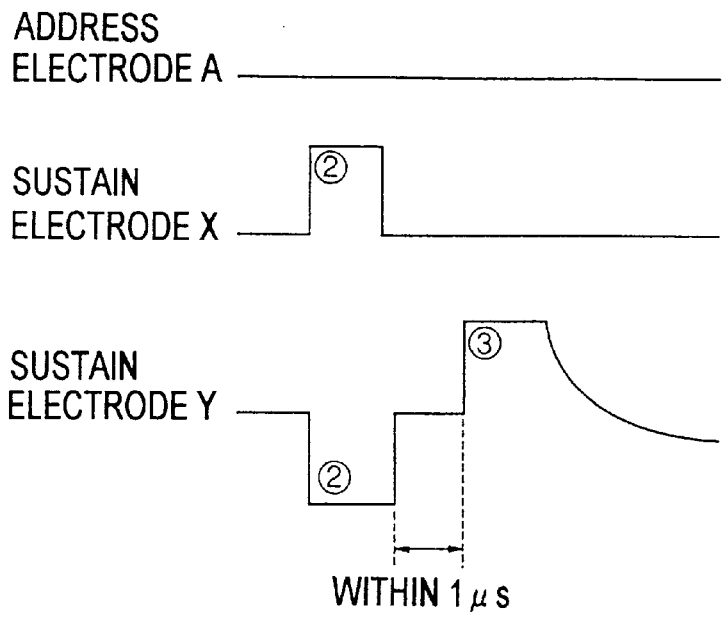
FIG. 10 illustrate another example of waveforms of voltage pulses in the case where pulses of positive polarity and of negative polarity are applied as writing pulses and timing of the writing pulses and a charge producing pulse.
Figure 11:
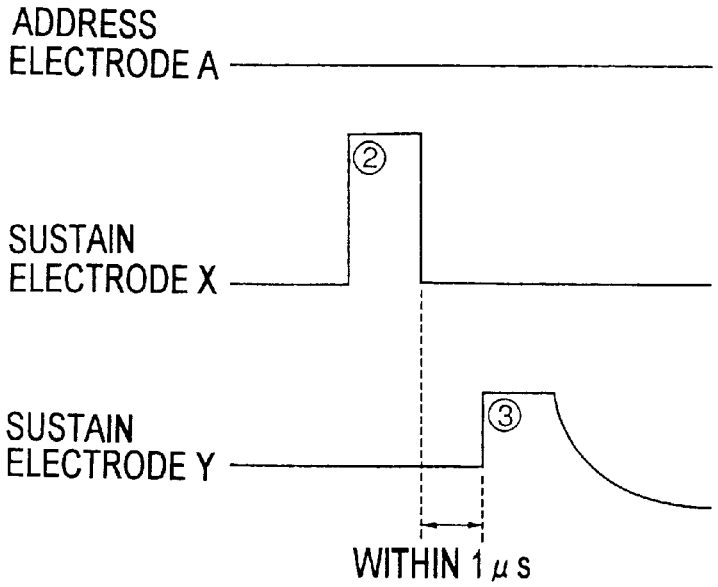
FIG. 11 illustrates timing of a writing pulse and a charge-producing pulse when a voltage pulse of 2×Vs is applied as a writing pulse.

FIGS. 10 and 11 show timing of the writing pulses and the charge-producing pulse. Referring to FIG. 10, voltage pulses of positive polarity and negative polarity are applied as writing pulses. Referring to FIG. 11, a voltage pulse of 2×Vs is applied as writing pulse. As shown in these figures, before the charge-producing pulse is applied, the self-erase discharge by the stored wall charge is produced after the writing discharge is finished. Then, within 1.0 μs including a period for grounding all the three electrodes, i.e., the sustain electrodes X and Y and the address electrodes A, the voltage pulse is raised at one of the sustain electrodes, Y, which is used for the address discharge so as to stop the self-erase discharge. Thereby, the space charge released in the discharge space is drawn to the electrodes by the applied voltage pulse to produce the wall charge.

Figure 12:
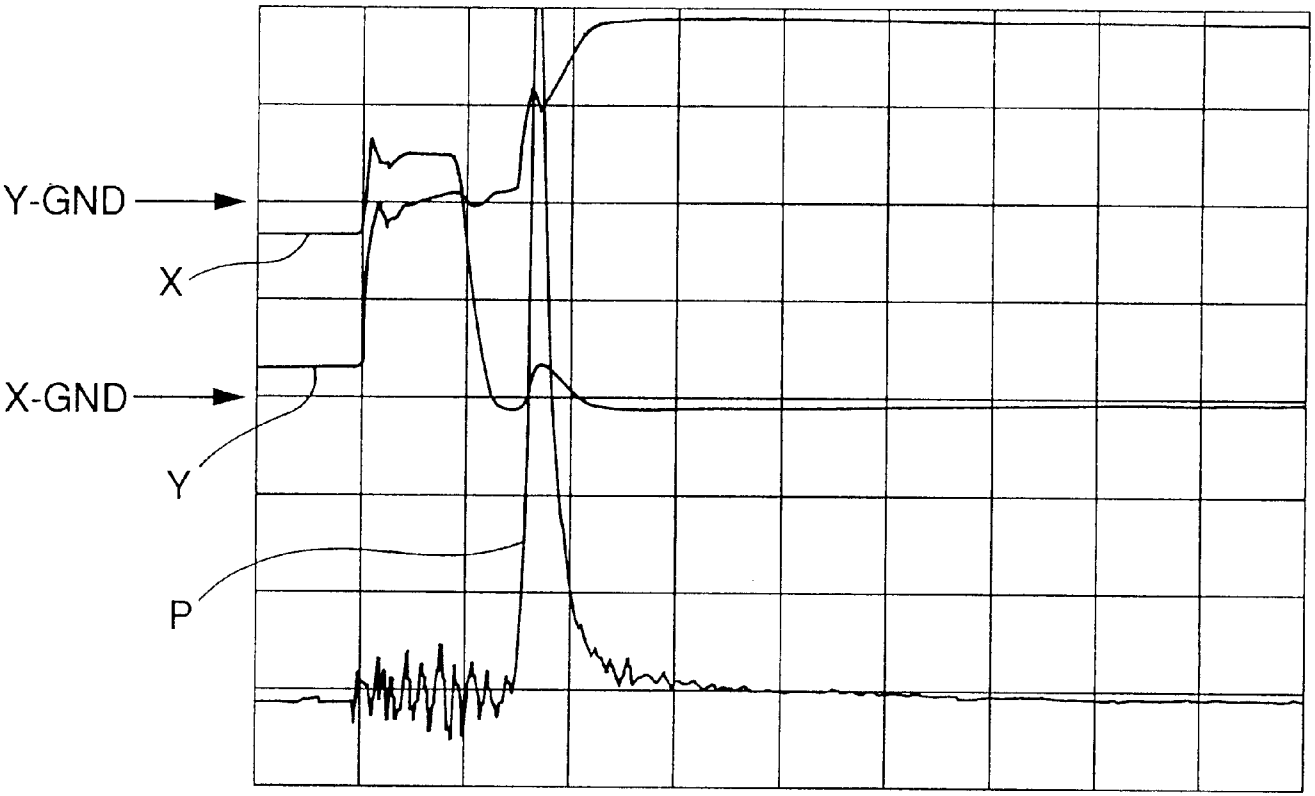
FIG. 12 illustrates charge-producing pulses applied to sustain electrodes X and Y and a measured light-emitting pulse.

FIG. 12 is a graph showing the waveforms of the charge-producing pulses applied to the discharge electrodes X and Y and the result of measurements of a light-emission pulse of a cell. In the figure, the applied voltage is plotted in ordinate with 100 V scales. Time is plotted in abscissa with 0.5 μs scales.

As shown in this figure, when the charge-producing pulses are applied to the sustain electrodes X and Y, the cell which has not been lighted in the preceding sub-field emits light by the self-erasing and charge-producing discharge as indicated by the light-emission pulse P.

Figure 13:
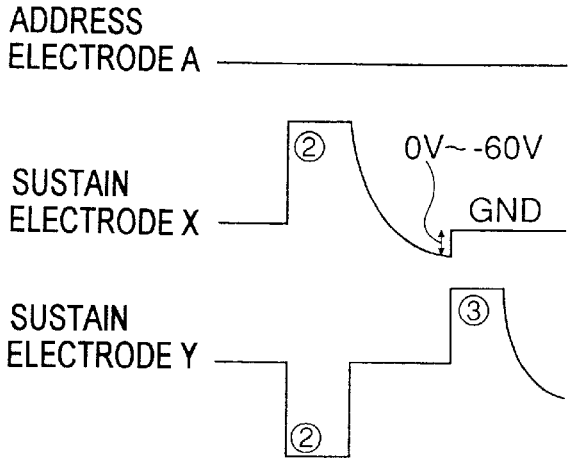
FIG. 13 illustrates an example wherein a writing pulse of positive polarity has a gently curved waveform.
Figure 14:
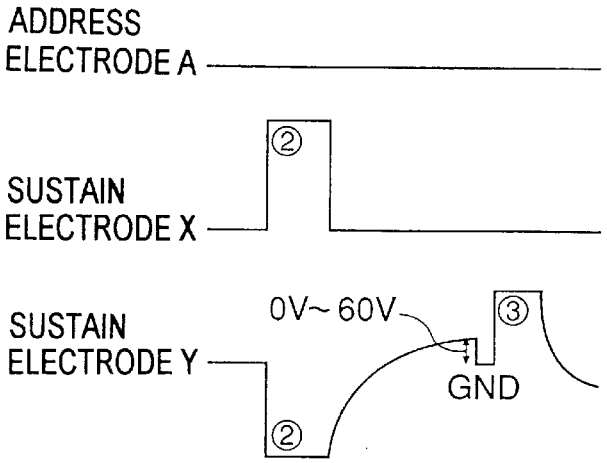
FIG. 14 illustrates an example wherein a writing pulse of negative polarity has a gently curved waveform.
Figure 15:
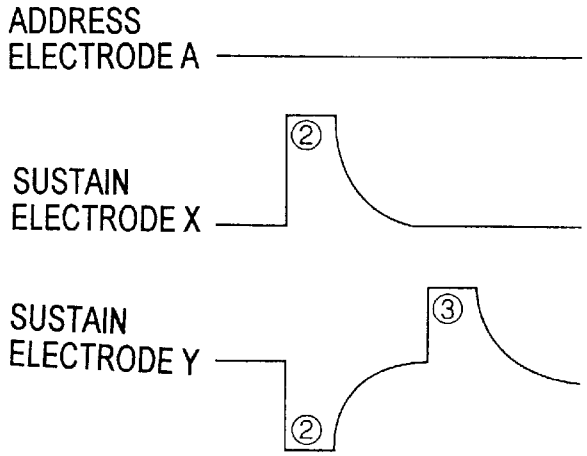
FIG. 15 illustrates an example wherein writing pulses of positive and negative polarities have gently curved waveforms.

FIGS. 13, 14, and 15 illustrate alternative examples of writing pulses.

In the above examples, as the writing pulses (the pulses ② in the figures) applied in the above-described initialization period, the voltage pulses of positive polarity and of negative polarity are applied to the sustain electrodes X and Y, respectively, then the sustain electrodes Xand Y are grounded abruptly to create the self-erase discharge. However, it is also possible not to generate the self-erase discharge even if the three electrodes are all grounded after the completion of the writing discharge.

For this purpose, the writing voltage pulse of positive polarity, the writing voltage pulse of negative polarity, or the both of them is/are constructed to have a gently curved waveform, and the voltage pulse of positive polarity is gradually lowered or/and the voltage pulse of negative polarity is gradually raised, with reducing the wall charge little by little.

FIG. 13 shows an example wherein the writing voltage pulse of positive polarity has a gently curved waveform, FIG. 14 shows an example wherein the writing voltage pulse of negative polarity has a gently curved waveform, and FIG. 15 shows an example wherein both the writing voltage pulses of positive polarity and of negative polarity have gently curved waveforms.

After such a writing pulse/such writing pulses is/are applied, the charge-producing pulse is applied to the sustain electrode Y which is used as the address discharge, so as to create a discharge and produce a uniform wall charge in all the cells. The application of the charge-producing pulse is timed to the grounding of the gently curved wave pulse of positive polarity in the case where the voltage pulse of positive polarity has a gently curved waveform, to the grounding of the gently curved wave pulse of negative polarity in the case where the voltage pulse of negative polarity has a gently curved waveform, and to the grounding of the gently curved wave pulses of positive polarity and of negative polarity in the case where both the voltage pulses of positive polarity and of negative polarity have a gently curved waveform.

The crest value of the charge-producing pulse applied in this case may be lower than that of the sustain pulse and a voltage of 140 to 200 V is preferably applied. The pulse width of the charge-producing pulse is referably 3 $\mu$s or more for ensuring the production of the wall charge. At the application of the charge-forming pulse, the address electrode A is grounded, as described above.

Thus by producing the uniform wall charge in the whole cells in the initialization period, the voltage of the address pulse applied for the later erase address discharge can be reduced and further the pulse width can also be reduced. Therefore, a high-speed, stable driving can be realized.

In the above-described First Embodiment, the present invention has been explained with a so-called three-electrode-facing PDP which is a kind of three-electrode AC surface discharge PDP wherein the sustain electrodes and the address electrode are formed on the front substrate and the rear substrate, respectively. However, the driving method of the present invention is applicable to a so-called three-electrode one-side-type PDP wherein the sustain electrodes and the address electrode are formed on either of the front substrate and the rear substrate.

SECOND EMBODIMENT

In the display of images by the above-described PDP, there exists a substantial hold period between the end of the sustain period for a certain image and the initialization period for the next image in time-sequential display of images with regular renewal. The hold period inevitably occurs when gradation display is performed with high fidelity to inputted imaged by a binary control on lighting. Normally, the hold period is equally assigned to each sub-frame (sub-field). The sum of the total hold periods is about 3 to 4 ms for an ordinary frame period of about 16.6 ms. A quiescent period of about several ten $\mu$s is sometimes required for resetting a logic circuit for driving in every sub-frame.

This hold period is unpreferable in the case of the erase address method. The reason is that the amount of remaining wall charge decreases during the hold period, and therefore the discharge probability at the initialization period becomes smaller than that at the sustain period. As a result, even if a voltage similar to that at the sustain period is applied at the initialization, a surface discharge does not always take place. Therefore, it is difficult to produce the wall charge uniformly in all the cells on the screen at the initialization.

In order to solve this problem, the initialization may be carried out immediately after the sustain period and then the hold period may be put after the initialization. However, the initialization to produce a uniformly charged state is desirably performed immediately before a subsequent operation to utilize the produced charge, unlike the initialization to form a non-charged state. In brief, the initialization is desirably carried out after the hold period.

In this embodiment, the initialization is carried out after the hold period for driving the PDP using the erase address method. However, the wall charge does not decrease, and the entire screen is uniformly charged. Therefore, the reliability of the initialization can be improved. In other words, Second Embodiment is a First Embodiment improved in part.

In this embodiment, the following four methods are used.

(1) Prior to the initialization (the uniforming of charged states), the wall charge and the space charge are produced by creating a surface discharge across the pair of sustain electrodes under the same conditions as in the sustain period, in order to optimize the discharge probability.

(2) The voltage applied for the initialization is set high so as to compensate for the decrease of charge during the hold period.

(3) The wall charge is produced in an excess amount at the end of the sustain period so as to allow for the decrease of charge during the hold period.

(4) The decrease of charge during the hold period is suppressed.

Here, described again is the driving method of First Embodiment, which represents a basic concept of the present invention. First Embodiment is a method of driving the AC surface discharge PDP provided with the first and the second main electrodes (sustain electrodes) extending in the same direction with a surface discharge gap therebetween. The method repeats a first process and a second process every time when the content of display is renewed. In the first process, a discharge is created only in the previously selected cells in which light emission is sustained in the immediately preceding display so as to reverse the polarity of the wall charge between the first and second sustain electrodes of said cells. In the second process, a discharge is created only in the previously non-selected cells which are cells other than the previously selected cells so as to produce the wall charge of the same polarity in the previously non-selected cells as the polarity of the wall charge in the previously selected cells. Through these first and second processes, charge distribution is uniformed on the screen.

In the method (1) of Second Embodiment, the sustain voltage (sustain pulse) is periodically applied across the first and the second sustain electrodes of all the cells. Then, prior to the initialization period (the uniforming of charge distribution), the sustain voltage is applied to the first and the second sustain electrodes of all the cells so as to create a surface discharge.

In the method (2) of Second Embodiment, a first sustain voltage is periodically applied across the first and second sustain electrodes of all the cells during the sustain period of each display, and in the above-described first process following the sustain period, a second sustain voltage which is higher than the first sustain voltage is applied across the first and second sustain electrodes of all the cells.

In an alternative method (2) of Second Embodiment, a step-wave voltage pulse whose crest value rises stepwise from the first sustain voltage is applied to the first or second sustain electrode of all the cells.

In the method (3) of Second Embodiment, during the sustain period of each display, a first sustain voltage is periodically applied across the first and second sustain electrodes of all the cells, and subsequently a second sustain voltage higher than the first sustain voltage is applied thereto a certain number of times before the end of the sustain period.

In an alternative method (3) of Second Embodiment, during the sustain period of each display, a rectangular-wave voltage pulse for sustaining light-emission is applied alternately to the first and second sustain electrodes of all the cells, and subsequently with keeping the order of application, a gently curved waveform voltage pulse whose value changes gradually at its trailing edge is applied thereto a certain number of times before the end of the sustain period.

In the method (4) of Second Embodiment, during the sustain period of each display, the sustain voltage is periodically applied across the first and second sustain electrodes of all the cells, and subsequently a state in which the last sustain voltage is being applied is maintained until the succeeding uniforming of the charge distribution.

The above four methods are described in detail along with the driving method of the First Embodiment.

Figure 16:
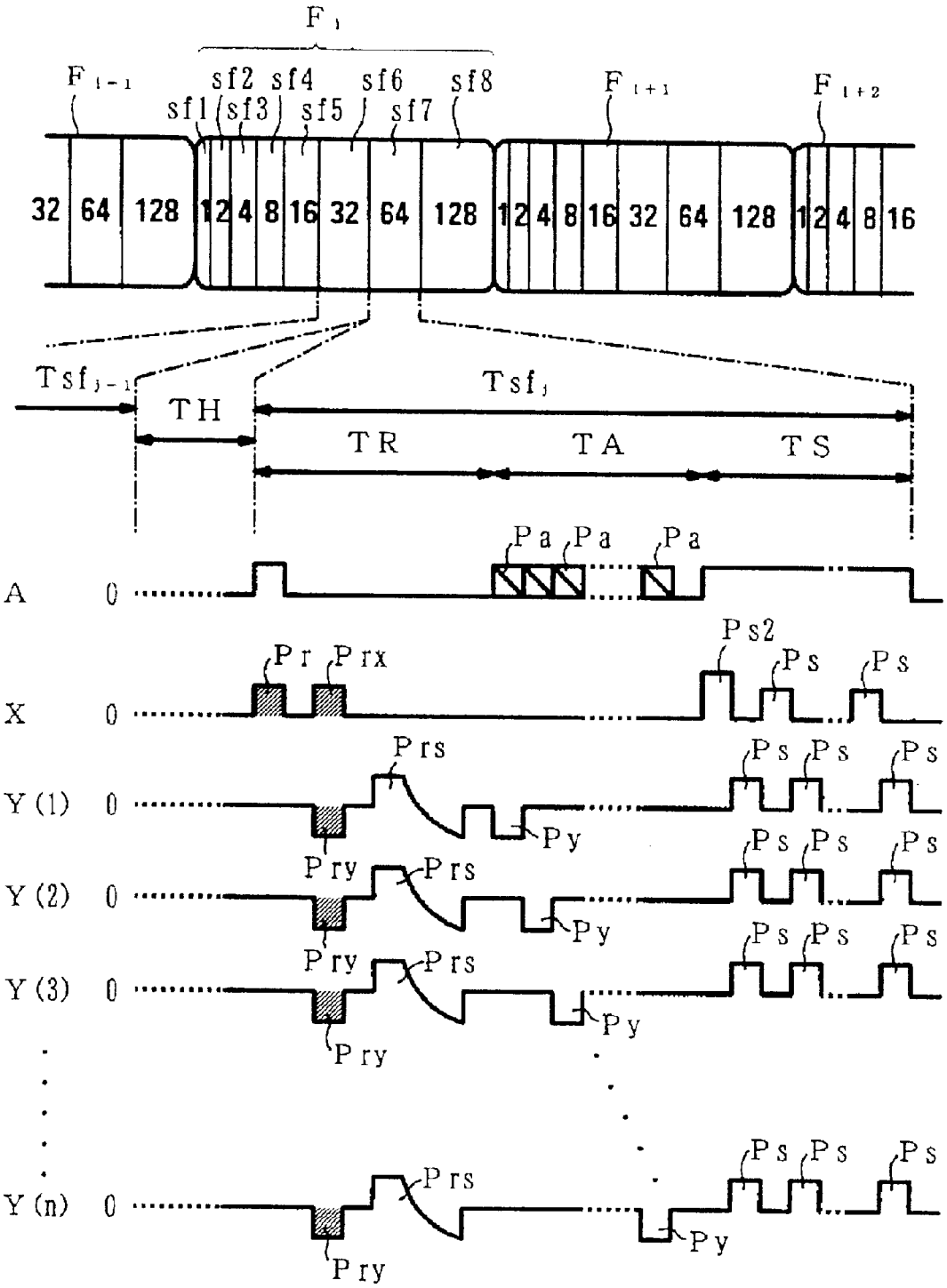
FIG. 16 is a schematic view outlining a frame structure and a drive sequence in accordance with Second Embodiment.

FIG. 16 is a schematic view outlining a frame structure and a drive sequence in accordance with Second Embodiment.

As described in Fist Embodiment, for reproducing gradation (gray scales) by binary control of lighting in the display of television images using the PDP, each frame F which is a time-sequential input image is divided into, for example, eight sequential sub-frames sf1, sf2, sf3, sf4, sf5, sf6, sf7 and sf8 as conventionally divided (the numerals of the reference marks represent the order in which the sub-frames are displayed). In other words, the frame F is replaced with a set of the eight sub-frames sf1 to sf8. In the case of reproducing images interlacingly scanned like television using an NTSC system, the frame is divided in two fields and each field is further divided to eight sub-fields. The numbers of light emissions in the sub-frames sf1 to sf8 are set to provide weighted luminances for the sub-frames so that the relative ratio of luminances of the sub-frames sf1 to sf8 is 1:2:4:8:16:32:64:128. Since 256 levels of luminance can be set for each of the colors R, G and B by changing combinations of lighting or non-lighting in each sub-frame. Thus $256^3$ colors can be displayed. The sub-frames sf1 to sf8 need not be displayed in the order of the weighted luminance. The order can be optimized, for example, by putting the sub-frame sf8 having the largest weight of luminance in the middle of a period of the frame.

A sub-frame period Tsf provided for each of the sub-frames sf1 to sf8 includes an initialization period TR, an address period TA and a sustain period TS. In the initialization period TR, the initialization is carried out to charge the entire screen uniformly. In the address period TA, the addressing (the setting of a light-emitting or non-light-emitting state) is performed by the erase address method. In the sustain period TS, the light-emitting state is maintained to realize the luminance in accordance with intended gradation levels. There are equally provided hold periods TH between sub-frame periods. Thus, the frame F corresponds to eight sub-frame periods Tsf and eight hold periods TH. Alternatively, each of the hold periods may be regarded as a part of the preceding or succeeding sub-frame period Tsf, and the sub-frame period Tsf may be regarded as a set of four periods (TH→TR→TA→TS or TR→TA→TS→TH).

The length of the initialization period TR and the address period TA is constant in all the sub-frames independently of the weighted luminance of the sub-frames, while the length of the sustain period TS is longer for a sub-frame which has a larger weighted luminance. Thus, eight sub-frames corresponding to one frame F differ from each other in length.

In the initialization period TR, wall charge of predetermined polarity is produced in the precedingly selected cells which have been lighted in the immediately preceding sub-frame and precedingly non-selected cells which have not been lighted in the immediately preceding sub-frame by a first step of applying a voltage pulse (charge-reversing pulse) Pr of positive polarity to the sustain electrode X and by a second step of applying a voltage pulse (writing discharge pulse) Prx of positive polarity and a voltage pulse (writing discharge pulse) Pry of negative polarity to the sustain electrode X and the sustain electrode Y, respectively. That is, all the cells are uniformly charges by the two-step process wherein, after the wall charge of the precedingly selected cells is reversed, a voltage about twice as large as the sustain voltage is applied to the precedingly non-selected cells to make them discharge. In the precedingly selected cells, when the voltage pulses Prx and Pry are applied, the wall charge reduces the applied voltages and therefore the discharge does not take place therein. In the first step, the address electrode A is biased to a positive potential to prevent an unnecessary discharge across the address electrode A and the sustain electrode X.

Subsequently to the second step, a voltage pulse Prs of positive polarity is applied to the sustain electrodes Y to generate a surface discharge in all the cells so as to improve the uniformity of charge. By this surface discharge, the charge polarity (polarity of the wall charge) is reversed. After then, the potential of the sustain electrodes Y is gradually reduced to prevent loss of charge.

In the address period A, the rows are selected one by one from a first row, and a scan pulse Py of negative polarity is applied to the sustain electrode (scan electrode) Y of the selected row. At the same time as the selection of the row, an address pulse Pa of positive polarity is applied to an address electrode A corresponding to a cell which is not to be lighted this time (cell not selected for display in this sub-frame). In the cell on the selected row to which cell the address pulse Pa is applied, an opposition discharge occurs across the sustain electrode Y and the address electrode A to erase wall charge on the dielectric layer 17. When the address pulse Pa is applied, there exists wall charge of positive polarity near the sustain electrode X. This wall charge cancels the address pulse Pa and therefore the discharge does not occur across the sustain electrode X and the address electrode A. Since this erase addressing does not need the re-production of charge unlike the write addressing, the erase addressing is suitable for high-speed driving. Time required for addressing one row is about 1.3 $\mu$s.

In the sustain period TS, all the address electrodes A are biased to a positive potential to prevent an unnecessary discharge. First a sustain pulse Ps2 of positive polarity is applied to all the sustain electrodes X. Then a sustain pulse Ps is applied alternately to the sustain electrodes Y and to the sustain electrodes X.

In this embodiment, the last sustain pulse Ps is applied to the sustain electrode Y. By the application of the sustain pulses Ps2 and Ps, a surface discharge takes place in cells whose wall charge is retained in the address period (cells to emit light for the display of this time). Preferably, the sustain pulse Ps2 applied first has a crest value higher than the sustain pulse Ps applied later, in order to ensure the generation of the surface discharge. It is also effective for stable sustaining to lengthen the pulse width. That is, decrease of charge during the addressing which needs time of a scanning cycle×the number of rows (e.g., 1.3 $\mu$s×1024) is taken into consideration.

Figure 17:
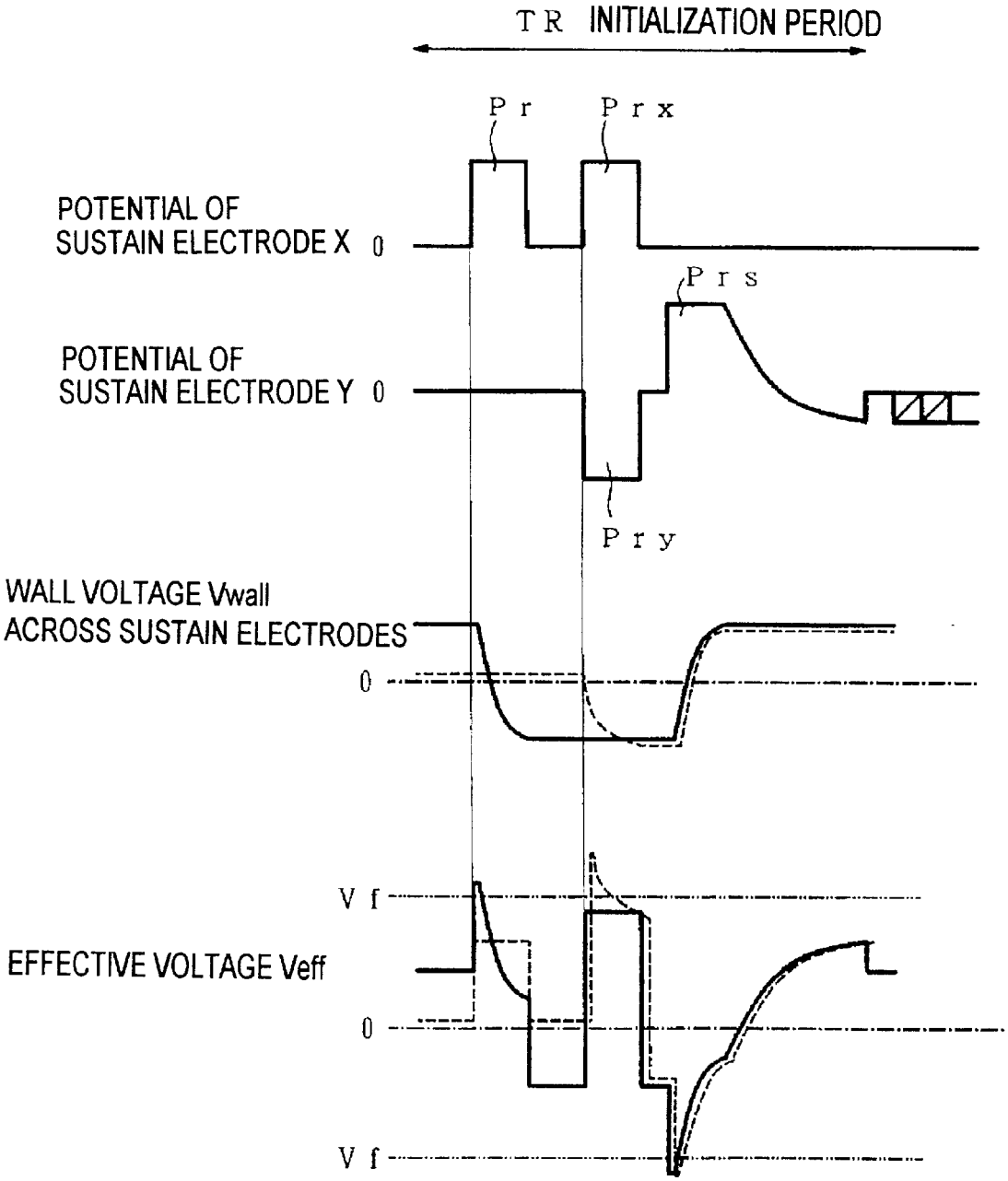
FIG. 17 shows exemplary voltage waveforms illustrating basic conception about initialization in accordance with Second Embodiment of the present invention.

FIG. 17 shows exemplary voltage waveforms illustrating a basis conception about initialization in accordance with Second Embodiment of the present invention. In this figure, the polarities of the wall voltage Vwall and the effective voltage Veff are based on the potential of the sustain electrode Y.

At the beginning of the initialization period TR, the precedingly selected cells maintains the wall charge generated by the surface discharge for sustaining light emission. The polarity thereof is positive on the sustain electrode X side and negative on the sustain electrode Y side since the last sustain pulse Ps is applied to the sustain electrode Y in the sustain period. Therefore, a positive wall voltage Vwall is present across the sustain electrodes (across the main electrodes) in the precedingly selected cells. In the precedingly non-selected cells, on the other hand, the wall voltage Vwall is zero since the wall charge has been erased in the preceding addressing.

In this state, if a voltage pulse Pr whose crest value is equal to or close to the crest value of the sustain pulse Ps is applied to the sustain electrode X, the effective voltage Veff in the precedingly selected cells exceeds a firing voltage Vf as shown by a solid line in the figure. For this reason, a surface discharge is generated in the precedingly selected cells to eliminate the wall charge and then re-produce wall charge. Thus the polarity of the wall charge is reversed. In the precedingly non-selected cells, however, the effective voltage Veff does not exceed the firing voltage Vf as shown by a dotted line in the figure and therefore the discharge does not take place. Thus a non-charged state is maintained.

Subsequently, if voltage pulses Prx and Pry of different polarities whose crest values are set such that the applied voltage is about twice as large as the sustain voltage (the crest value Vs of the sustain pulse Vs) are applied, the effective voltage Veff of the precedingly non-selected cells exceeds the firing voltage Vf and generates a surface discharge. Thereby, a negative wall voltage Vwall is present in the precedingly non-selected cells like the precedingly selected cells. In the precedingly selected cells, on the other hand, the wall voltage Vwall lowers the applied voltage and the effective voltage Veff does not exceed the firing voltage. Therefore, the charged state of the precedingly selected cells is maintained. To sum up, the precedingly selected cells and the precedingly non-selected cells are similarly charged. However, since the amount of charge may be a little different (usually, the charge in the precedingly non-selected cells are more), a voltage pulse Prs is applied to generate the surface discharge for adjusting the amount of charge.

In such initialization for charging the entire screen uniformly by utilizing the wall charge as described above, especially, the discharge must be surely generated only in the precedingly selected cells in the first step and the wall charge must be produced in an appropriate amount. If the wall charge decreases during the hold period before the initialization period TR and only insufficient wall charge remains at the beginning of the initialization, the surface discharge, if occurs, is too weak in intensity to re-produce enough wall charge. In this case, in the second step wherein the voltage pulses Prx and Pry is applied, the surface discharge which must be generated only in the precedingly non-selected cells takes place also in the precedingly selected cells since the applied voltage is canceled insufficiently by the wall charge. The discharge in the second step makes the polarity of the wall voltage in the precedingly selected cells opposite to the normal polarity (negative). In addition, if the discharge in the first step is a little strong, it does not matter.

Therefore, the following driving methods are applied for improving the reliability of the initialization.

Figure 18:
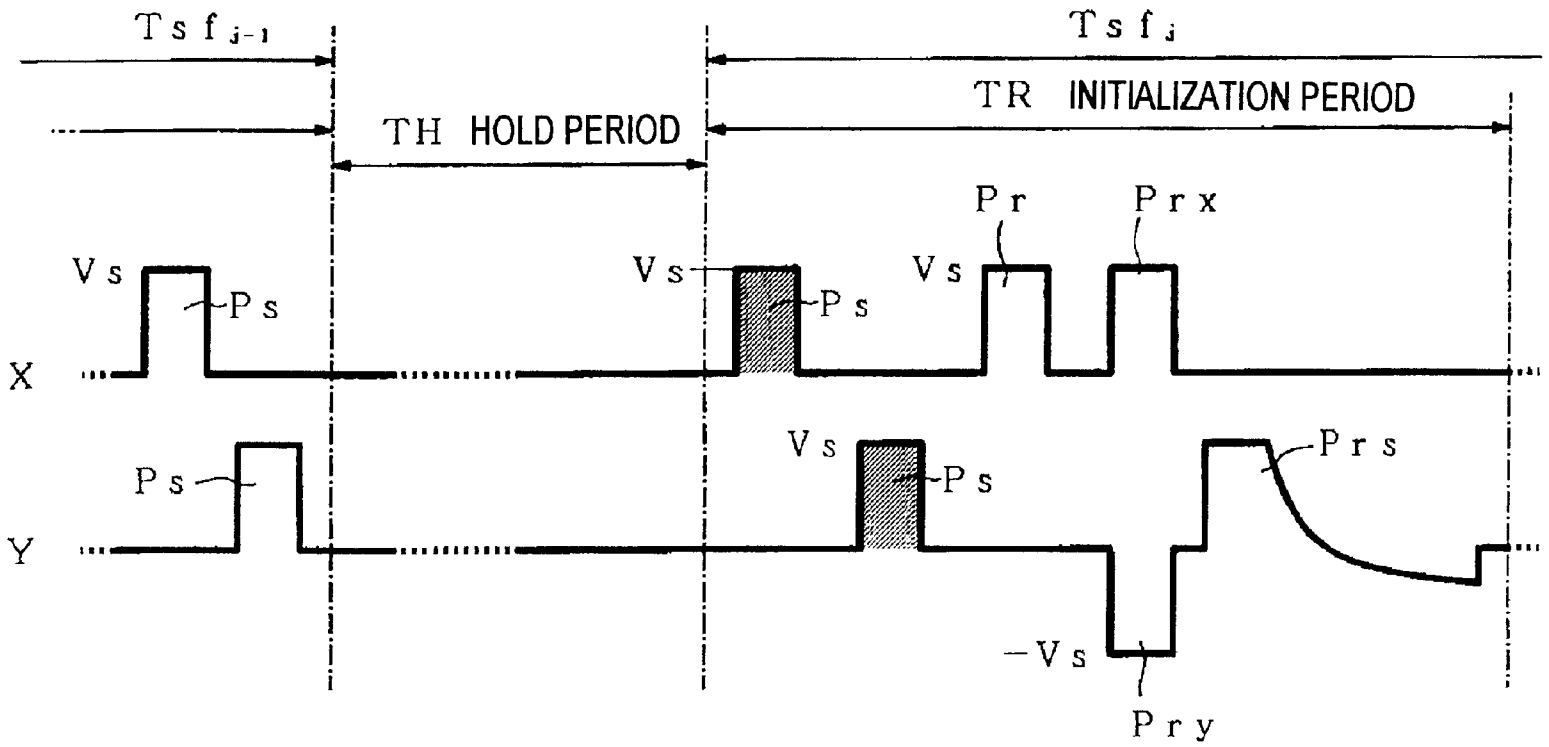
FIG. 18 shows voltage waveforms in accordance with Example 1 of Second Embodiment of the present invention.

FIG. 18 shows voltage waveforms in accordance with Example 1 of Second Embodiment of the present invention.

When the hold period TH finishes, at least one sustain pulse Ps whose crest value is the same as the sustain voltage Vs for sustaining light-emission is applied prior to the application of the voltage pulse Pr. The electrode to which this sustain pulse Ps is applied is chosen so that the remaining wall charge can be utilized for a discharge. In this example, since the sustain pulse Ps is positive and the last sustain pulse in the preceding sustain period TS is applied to the sustain electrode Y, the sustain pulse Ps is first applied to the sustain electrode X, and then applied to the sustain electrode Y so that the polarity of the charge fits to the voltage pulse Pr.

In the example shown in FIG. 18, a pair of sustain pulses Ps is applied, and the surface discharge by the voltage pulses Pr is the third discharge after the hold period TH. The wall charge becomes more stable through repeated surface discharges. The charge which decreases during the hold period TH recovers the level at the end of the last sustain period through these two preliminary surface discharges. Thus, even if the wall charge is somewhat insufficient at the end of the hold period TH, a proper surface discharge can be generated by the application of the voltage pulse Pr so that the initialization can surely be completed.

Figure 19:
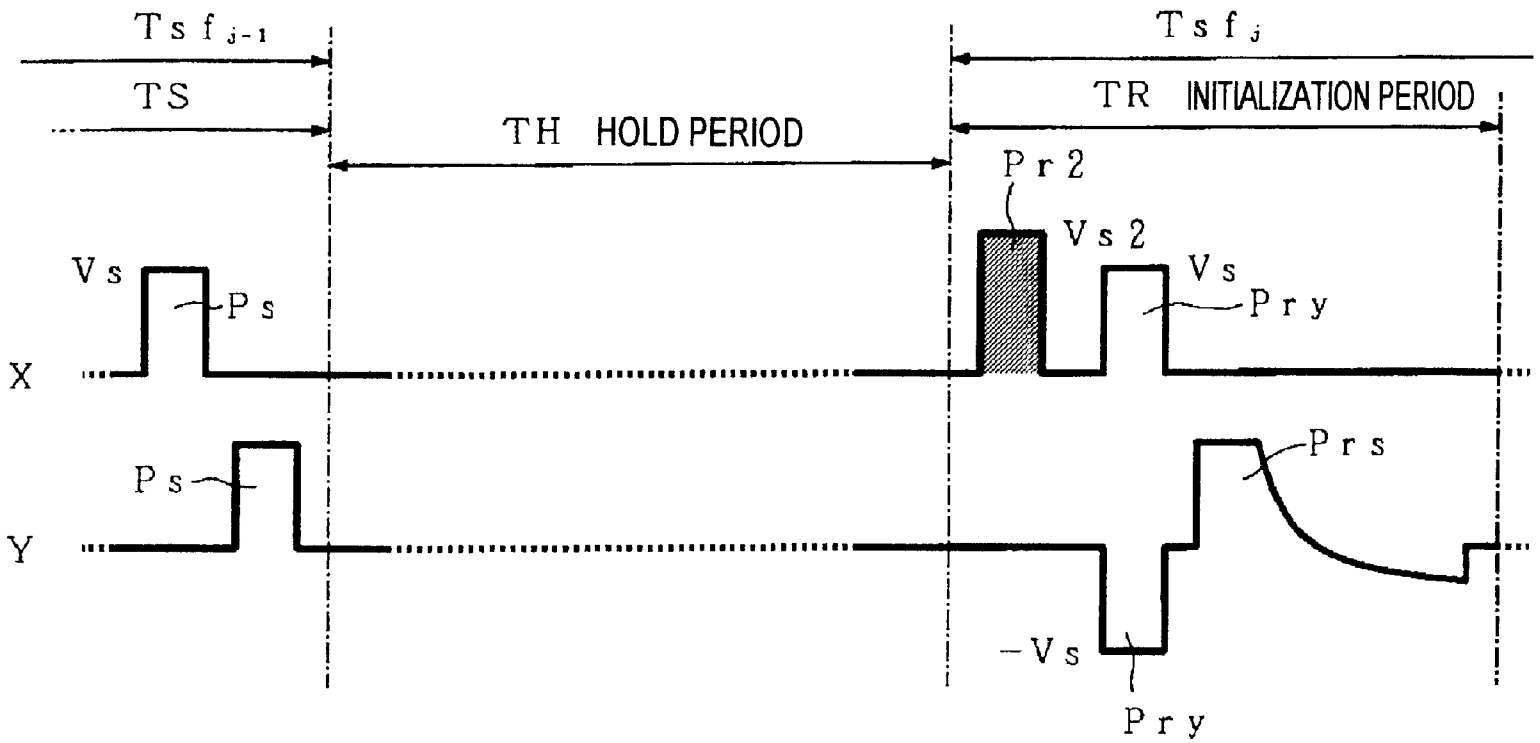
FIG. 19 shows voltage waveforms in accordance with Example 2 of Second Embodiment of the present invention.

FIG. 19 shows voltage waveforms in accordance with Example 2 of Second Embodiment.

In the first step of the initialization, a positive voltage pulse Pr2 having a crest value of Vs2 is applied in place of the voltage pulse Pr. The crest value Vs2 is 5 to 40 volts higher than the crest value Vs of the sustain pulse Ps and lower than the firing voltage Vf ($Vs<Vs2<Vf$). In other words, the voltage applied in the first step is a sustain voltage higher than normal. Thus, even if the wall charge is somewhat insufficient at the end of the hold period TH, a proper surface discharge can be generated so that the initialization can surely be completed. For raising the discharge probability, the pulse width may be lengthened instead of heightening the crest value.

Figure 20:
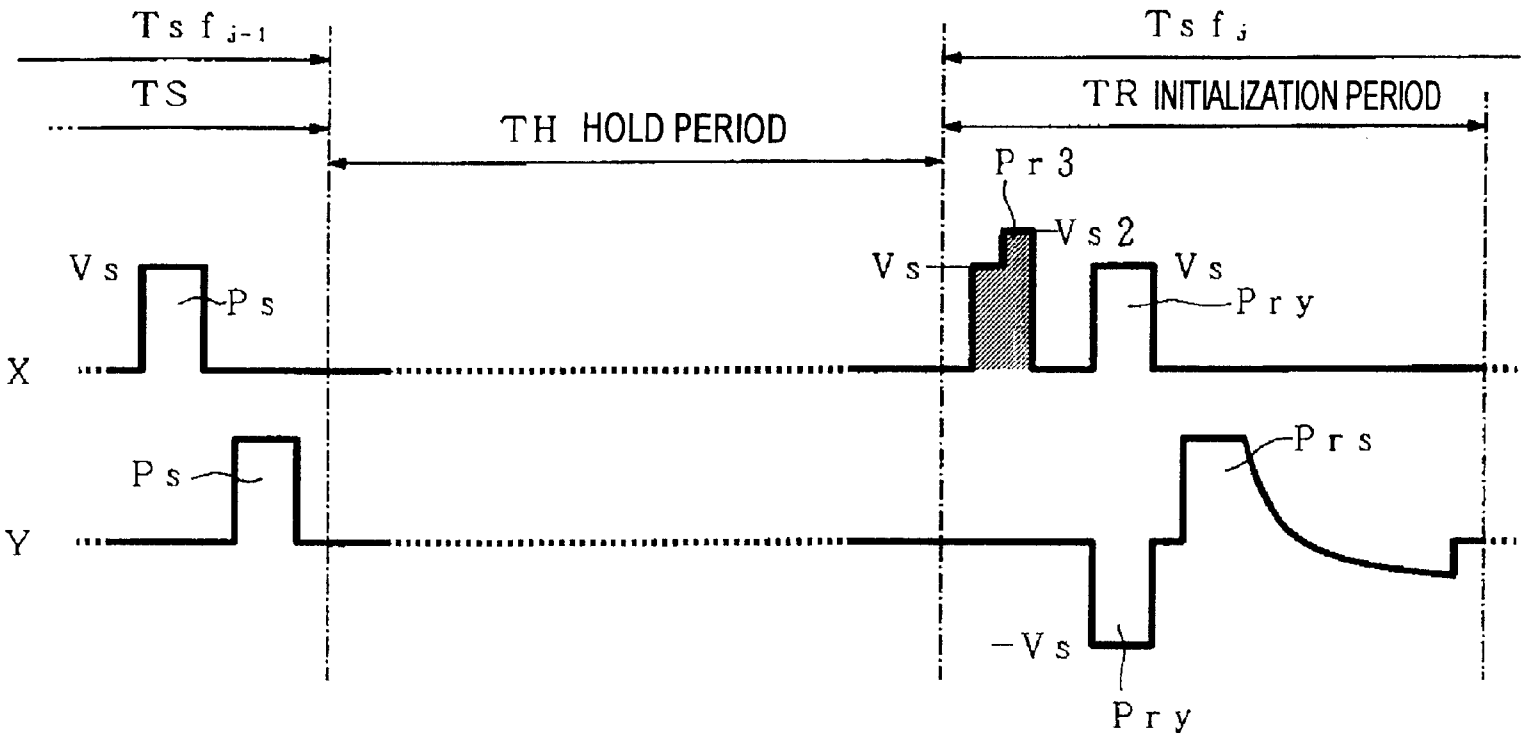
FIG. 20 shows voltage waveforms in accordance with an modified Example 2 of Second Embodiment of the present invention.

FIG. 20 shows voltage waveforms in accordance with a modified Example 2 of Second Embodiment.

In the first step of the initialization, a step-wave voltage pulse Pr3 is applied. The crest value of the step-wave voltage pulse Pr3 shifts stepwise from the normal sustain pulse Vs to the higher sustain pulse Vs2. In cells of the precedingly selected cells which have a relatively high discharge probability, a proper surface discharge takes place when the crest value of Pr3 is still low. Since the effective voltage Veff declines once the discharge occurs, the discharge does not occur again when the crest value of Pr3 becomes higher. In cells of the precedingly selected cells which have a relatively low discharge probability, on the other hand, the surface discharge takes place when the crest value of Pr3 becomes high. Though the surface discharge starts later, the discharge intensity is high because the applied voltage is high, and the wall charge is reproduced to the same degree as in the cells in which the discharge starts earlier. Thus, even if the amount of remaining wall charge in cells varies, a proper surface discharge can be generated in all the precedingly selected cells so that the initialization can surely be performed.

Figure 21:
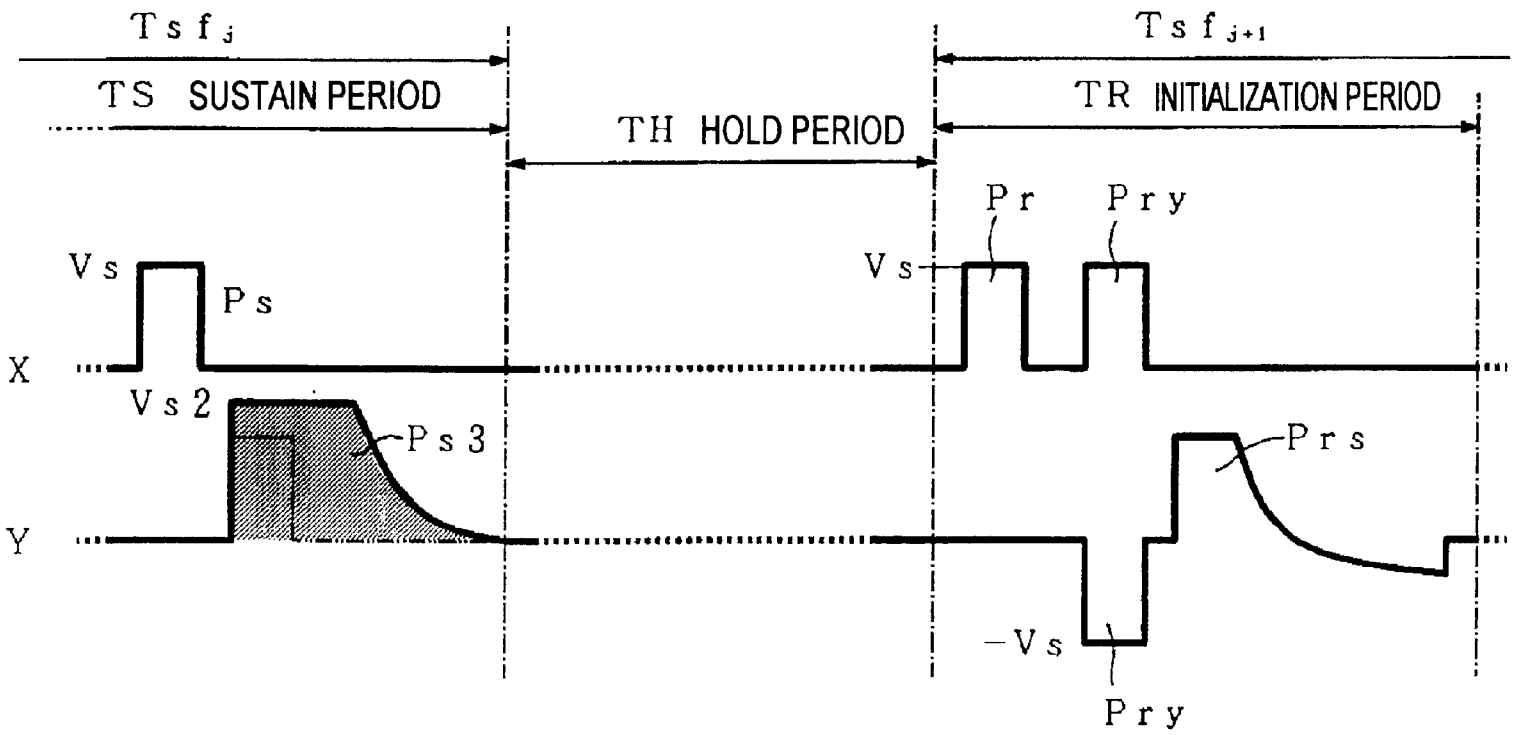
FIG. 21 shows voltage waveforms in accordance with Example 3 of Second Embodiment of the present invention.

FIG. 21 shows voltage waveforms in accordance with Example 3 of Second Embodiment.

A gently curved voltage pulse Ps3 whose voltage gradually changes at its trailing edge is applied as the pulse applied last in the sustain period TS or such a voltage pulse Ps3 is applied repeatedly as a plurality of pulses including the pulse applied last in the sustain period TS. The crest value of the gently curved voltage pulse Ps3 is equal to or higher than that of the normal sustain voltage Vs and preferably has a pulse width longer than that of the normal sustain voltage Vs. The discharge becomes stronger by a pulse with a higher crest value and time for electrostatic attraction is prolonged by a pulse with a longer pulse width. Therefore, more wall charge is produced at the end of the sustain period. Here, the gradual shift of the voltage at its trailing edge controls the neutralization of the wall charge and the space charge compared with a brisk change at the trailing edge. When the bias potential of the sustain electrode Y becomes zero, there remains a lot of wall charge. Thus even if the wall charge decreases during the hold period TH, a proper amount of wall charge remains at the beginning of the initialization, and thus the initialization can surely be performed.

Figure 22:
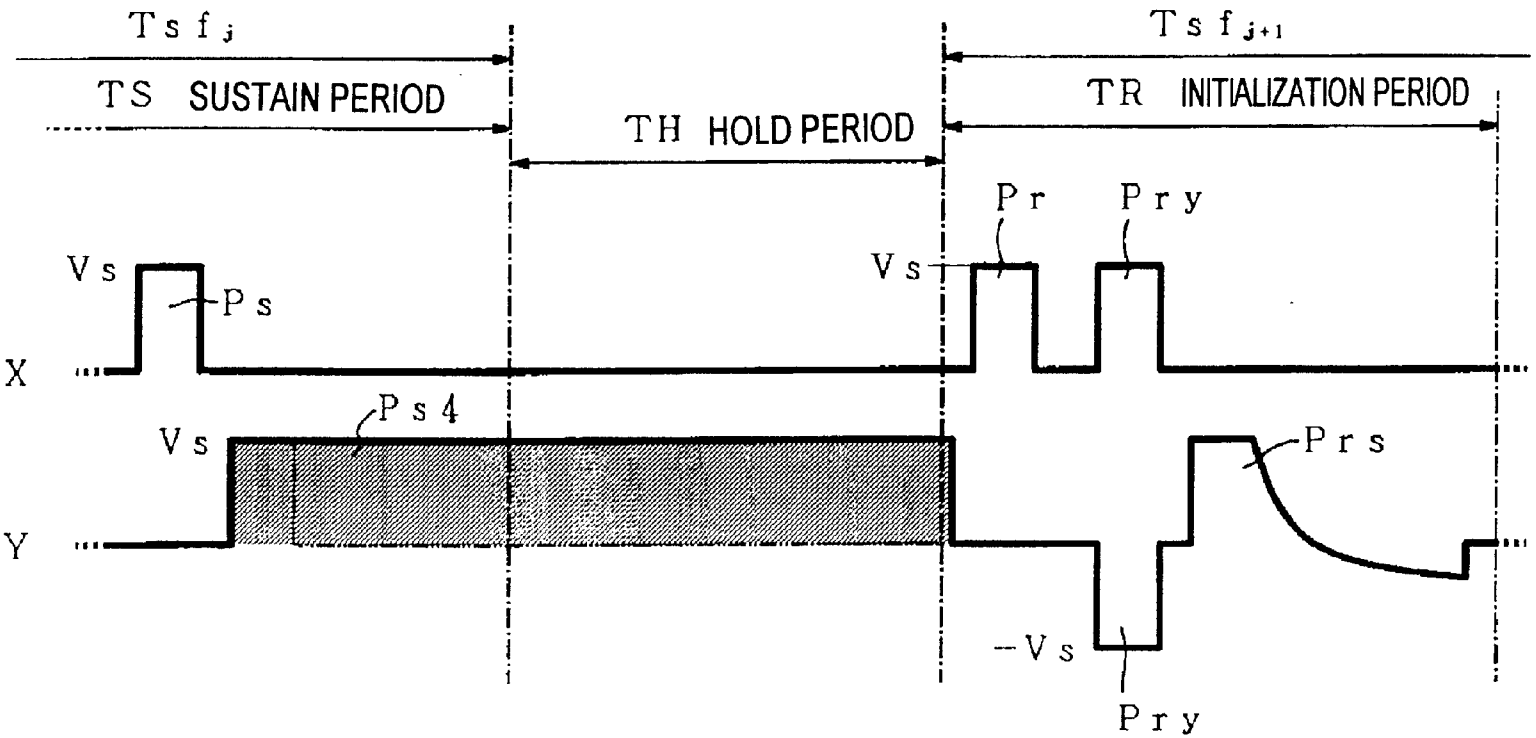
FIG. 22 shows voltage waveforms in accordance with Example 4 of Second Embodiment of the present invention.

FIG. 22 shows voltage waveforms in accordance with Example 4 of Second Embodiment.

After the sustain voltage Vs is applied to generate the last surface discharge in the sustain period TS, the sustain voltage Vs is kept applied until the initialization period TR. In other words, a sustain pulse Ps4 having such a long pulse width as include the hold period TH is applied last in the sustain period TS. The neutralization of charge in the hold period TH is suppressed thereby and an appropriate amount of charge remains at the beginning of the initialization. Thus the initialization can surely be performed.

In the above-described Second Embodiment, in order to reduce the deterioration of the fluorescent layers due to the address discharge, the address pulse Pa is first set to be positive, and then the polarities of the other pulses are set to be fit for the positive address pulse Pa. In order to simplify the drive circuit, the sustain pulse only of positive polarity is applied alternately to the pair of the sustain electrodes . The present invention, however, is not limited thereto. That is, the polarities of the applied voltages can be varied. As for the voltage pulses Prx and Pry in the second step of the initialization, the setting of the crest values is optional, but it is advantageous for circuit construction to equipotentially oppose the voltage pulses Prx and Pry like a combination of Vs and −Vs as shown in the examples.

THIRD EMBODIMENT

In the above-described First and Second Embodiments, however, even though the wall charge in the cells which need not emit light is normally erased, there are cases where space charge produced by the discharge for erasure remains excessively. In such cases, when the sustain pulse is applied, the priming effect of the space charge cause a discharge in the cells which need not emit light (mis-lighting). As a result, the wall charge is re-produced.

In this embodiment, described is a driving method for the PDP which allows prevention of such mis-lighting and realization of high-quality display free of flicker. In brief, Third Embodiment is partially improved First and Second Embodiments.

In this embodiment, the discharge probability is lowered at the beginning of the sustain period within such a range that failure in lighting does not occur, compared with that in the succeeding stages of the sustain period. Thereby, the discharge does not happen in non-selected cells which does not have a proper amount of wall charge, and if it happens, the discharge is weak and the wall charge is not produced again.

In order to lower the discharge probability, the pulse width of a certain number of voltage pulses which are applied at the beginning of the sustain period may be shorter than the width of the other sustain voltage pulses, or the crest value of a certain number of voltage pulses which are applied at the beginning of the sustain period may be lower than the crest value of the other sustain pulses. This certain number is preferably 1, 2 or 3.

Figure 23:
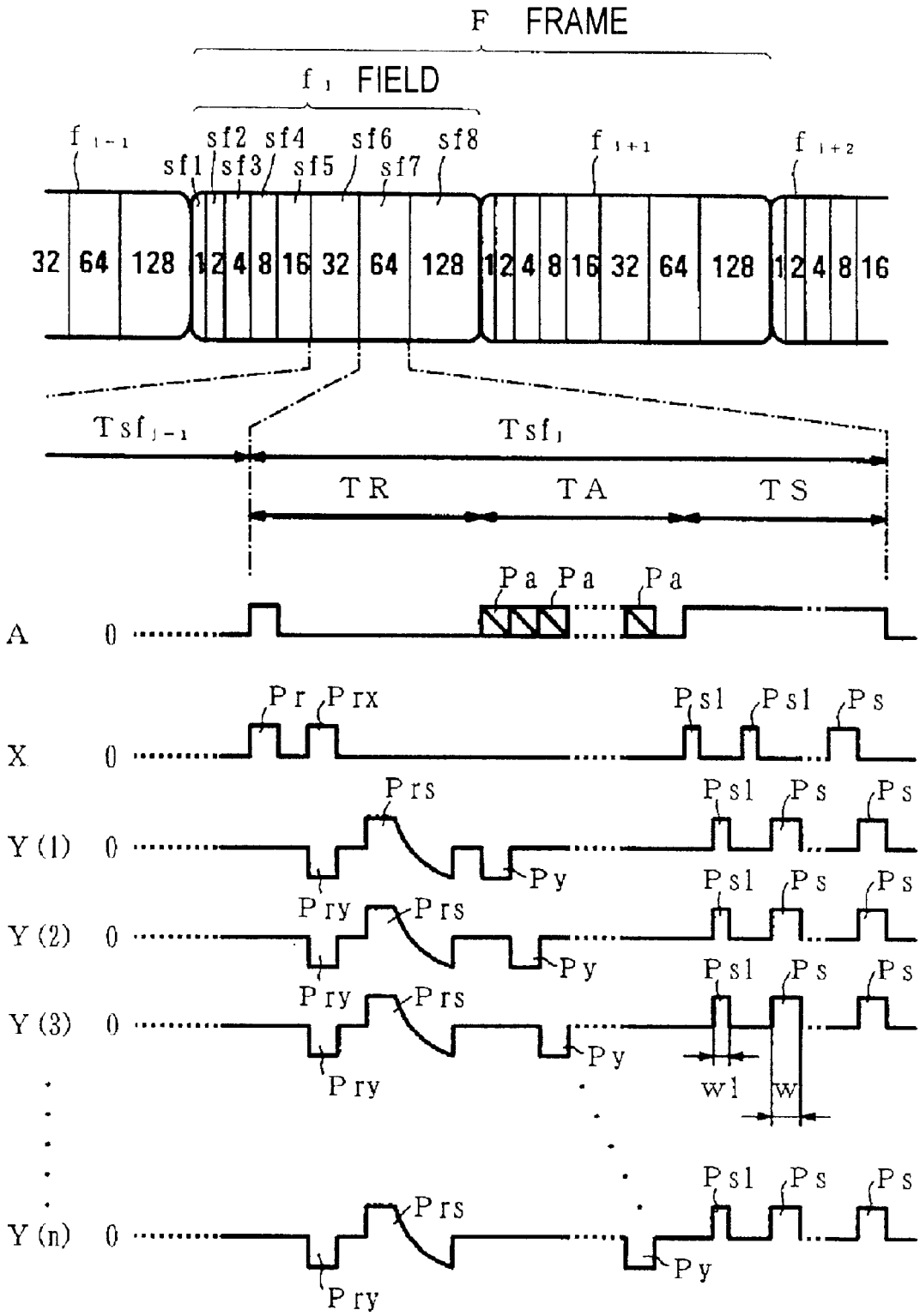
FIG. 23 is a schematic view outlining a frame structure and a drive sequence in accordance with Third Embodiment of the present invention.

FIG. 23 illustrates a field construction and a drive sequence in accordance with Third Embodiment of the present invention.

In this embodiment, operations in the initialization period and the address period are substantially the same as those of the above-described First and Second Embodiments. Therefore, described here is only an improved operation in the sustain period.

In this embodiment, the pulse width w1 of the first to third sustain pulses Ps1 which are applied at the beginning of sustain period TS is shorter than the pulse width w of other fourth and later sustain pulses Ps. Thereby, in the non-selected cells which are not to emit light in the current sustain period, a discharge hardly occurs and, if it does, the wall charge is not produced because the voltage is applied only for a short time. In the selected cells which are to emit light in the current sustain period, on the other hand, the surface discharge is generated because there exist an appropriate amount of wall charge at the end of the erase addressing. The pulse width w1 may be chosen so that the wall charge remains in an amount sufficient for sustaining the light emission in the selected cells.

Figure 24A:
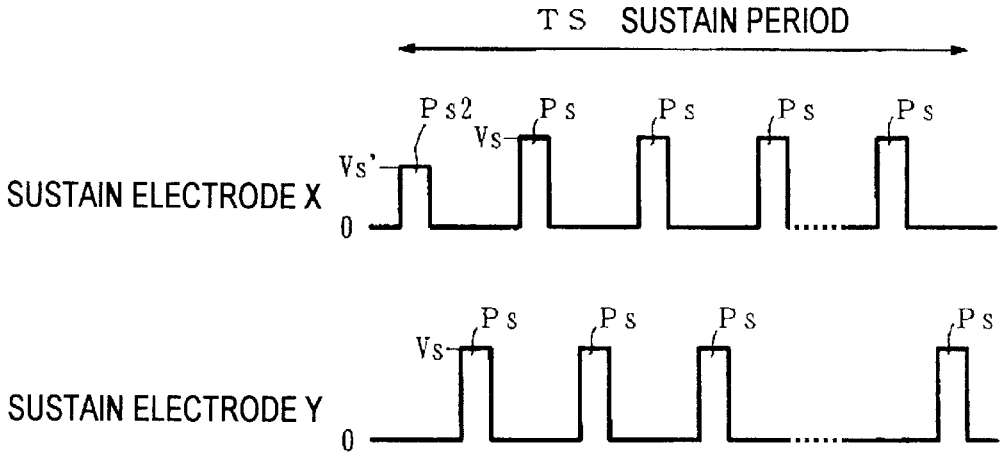
FIGS. 24A and 24B show voltage waveforms for driving during a sustain period TS in accordance with other examples of Third Embodiment.
Figure 24B:
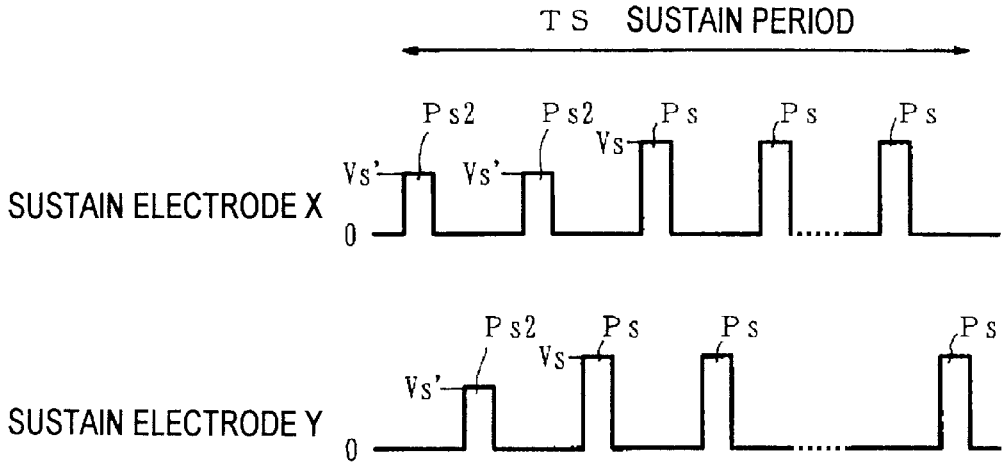

FIGS. 24A and 24B show driving voltage waveforms during the sustain period TS in accordance with another example of Third Embodiment.

In this example, the crest value Vs' of a certain number of sustain pulses Ps2 at the beginning of the sustain period Ts is lower than the crest value Vs of the following sustain pulses Ps in order to prevent mis-lighting of the cells to be off. A practical difference between the crest values Vs' and Vs is within the range of about 5 to 20 V.

In the example shown in FIG. 24A, the crest value only of the first sustain pulse Ps2 which is applied to the sustain electrode X is low. In the example shown in FIG. 24B, the crest value of the first to third sustain pulses Ps2 is lower than that of the other sustain pulses. The more sustain pulses have a lower crest value, the more certainly the mis-lighting can be prevented, but the less advantageous for ensuring the luminance of the selected cells. In sub-fields whose weight of luminance is small, the mis-lighting affects little, but the decline in the luminance is easily noticed. Therefore, for example, only the first sustain pulse may have a lower crest value in a sub-field having a small weight of luminance, and the first to fifth sustain pluses may have a lower crest value in a sub-field having a large weight of luminance. In such a manner, the number of applications of the sustain pulses Ps2 may be selected for every sub-field. Alternatively, the number of applications of the sustain pulses Ps2 may be the same through all the sub-fields. Such selection about the number of applications is also applicable in the case of the above-mentioned shorter pulse width.

In the above-described Third Embodiment, in order to reduce the deterioration of the fluorescent layers due to the address discharge, the address pulse Pa is first set to be positive, and then the polarity of the other pulses is set to be fit for the positive address pulse Pa. In order to simplify the drive circuit, the sustain pulse only of positive polarity is applied alternately to the pair of sustain electrodes. The present invention, however, is not limited thereto. That is, the polarities of the applied voltages can be changed.

As described above, according to the present invention, a high-speed, stable driving can be realized. Thereby, a plasma display panel of high display quality which is highly reliable and consumes less electric power can be obtained.

Further, the initialization for uniformly charging the entire screen can be performed with improved reliability.

Still further, the mis-lighting in the sustain period can be prevented and thereby display of high quality without flickers can be realized.

What is claimed is:

1. A method for driving a plasma display panel provided with a screen for displaying an image, the screen including a plurality of discharge cells having a memory function by means of wall charge, which comprises carrying out an erase address operation according to data of an image to be displayed when a display on the screen is renewed, wherein the erase address operation comprises the steps of:

carrying out an address preparation operation for producing the wall charge in all the discharge cells through a first step of generating a discharge only in a discharge cell in an ON-state in which a discharge is sustained on the screen before the renewal, so as to reverse the polarity of wall charge therein, and a second step of generating a discharge only in a discharge cell in an OFF-state which is other than the ON-state discharge cell, so as to produce wall charge of the same polarity as that in the ON-state discharge cell; and carrying out an operation for selectively erasing the wall charge in a discharge cell other than a discharge cell corresponding to the data of the image to be displayed.

2. The method according to claim 1, wherein the first step comprises application to all the discharge cells of a voltage higher than a sustain voltage for sustaining a discharge.

3. The method according to claim 2, wherein the voltage applied in the first step is a step-wave voltage pulse whose crest value increases stepwise from the sustain voltage.

4. The method according to claim 1, wherein the second step comprises application to all the discharge cells of a voltage capable of generating a discharge whose crest value is higher than a sustain voltage for sustaining a discharge.

5. The method according to claim 4, wherein the voltage applied in the second step is a step-wave voltage pulse whose crest value increases stepwise.

6. The method according to claim 4, wherein the voltage applied in the second step is a voltage pulse of gently curved waveform whose crest value increases gradually.

7. The method according to claim 4, wherein the voltage applied in the second step is a voltage having a crest value about twice as high as that of the sustain voltage.

8. The method according to claim 1 further comprising, after the second step, a third step of generating a self-erase discharge in the OFF-state discharge cell and, before the self-erase discharge finishes, applying a voltage for producing the wall charge to all the discharge cells thereby to stop the self-erase discharge and re-produce the wall charge.

9. The method according to claim 8, wherein, after the voltage for producing the wall charge is applied in the third step, the voltage is gradually reduced.

10. The method according to claim 1 further comprising, prior to the first step, applying to all the discharge cells a voltage as high as a sustain voltage for sustaining a discharge thereby to generate a discharge in the ON-state discharge cell.

11. A method for driving a plasma display panel provided with a screen for displaying an image, the screen including a plurality of discharge cells having a memory function by means of wall charge, which comprises carrying out an address operation on all the discharge cells on the screen for selectively producing the wall charge for the memory function to write data of an image on the screen; and carrying out an sustain operation on all the discharge cells on the screen for generating a discharge in discharge cells in which the wall charge is produced so as to display the image, wherein the address operation comprises the steps of:

carrying out an address preparation operation for producing the wall charge in all the discharge cells through a first step of generating a discharge only in a discharge cell in an ON-state in which a discharge is sustained on the screen before the writing of the data of the image so as to reverse the polarity of the wall charge therein and a second step of generating a discharge only in a discharge cell in an OFF-state in which a discharge is not sustained before the writing of the data of the image so as to produce the wall charge of the same polarity as that in the ON-state discharge cell; and carrying out an operation for selectively erasing the wall charge in a discharge cell other than a discharge cell corresponding to the data of the image to be displayed.

12. The method according to claim 11, wherein, in the sustain operation, a first sustain voltage pulse is periodically applied to all the discharge cells and subsequently a second sustain voltage pulse higher than the first sustain voltage pulse is applied a certain number of times before the sustaining of the discharge is finished.

13. The method according to claim 11, wherein, in the sustain operation, a sustain voltage pulse of rectangular waveform for sustaining a discharge is periodically applied to all the discharge cells and subsequently a sustain voltage pulse of gently curved waveform whose voltage shifts gradually at the trailing edge thereof is applied a certain number of times before the sustaining of the discharge is finished.

14. The method according to claim 11, wherein, in the sustain operation, a sustain voltage for sustaining a discharge is periodically applied to all the discharge cells and a state in which the sustain voltage is applied last is maintained until the first step of the address operation.

15. The method according to claim 11, wherein, in the sustain operation, a sustain voltage for sustaining a discharge is periodically applied to all the discharge cells and the pulse width of a certain number of sustain voltage pulses applied in an opening stage of the sustain operation is shorter than that of other sustain voltage pulses.

16. The method according to claim 11, wherein, in the sustain operation, a sustain voltage for sustaining a discharge is periodically applied to all the discharge cells and the crest value of a certain number of sustain voltage pulses applied in an opening stage of the sustain operation is lower than that of other sustain voltage pulses.

17. The method according to claim 15, wherein the certain number is one, two or three.

18. The method according to claim 16, wherein the certain number is one, two or three.

19. A method for driving a plasma display panel provided with a plurality of discharge cells arranged in matrix each having a memory function by means of wall charge, so as to write data of a picture in the plasma display panel, which comprises:

an address preparation step for producing the wall charge in all discharge cells used for displaying a picture; and an address step for erasing the produced wall charge in a non-selected discharge cell which need not be lighted, wherein the address preparation step comprises a first step of generating a discharge only in a discharge cell in an ON-state in which a discharge is sustained before the writing of data of the picture, so as to reverse the polarity of wall charge therein, and a second step of generating a discharge only in a discharge cell in an OFF-state in which a discharge is not sustained before the writing of the data of the picture, so as to produce wall charge of the same polarity as that in the ON-state discharge cell.

20. The method according to claim 19, wherein the plasma display panel comprises a plurality of pairs of parallel sustain electrodes covered with a dielectric layer which correspond to a plurality of display rows and a plurality of address electrodes extending in a direction intersecting the pairs of sustain electrodes, the pairs of sustain electrodes and the address electrodes being oppositely arranged with a discharge space therebetween and defining the plurality of discharge cells arranged in matrix at intersections of the pairs of sustain electrodes and the address electrodes.

21. The method according to claim 20, wherein the first step comprises application to the pairs of sustain electrodes of all the discharge cells used for displaying the picture of a voltage higher than a sustain voltage for sustaining a discharge.

22. The method according to claim 21, wherein the voltage applied in the first step is a step-wave voltage pulse whose crest value increases stepwise from the sustain voltage.

23. The method according to claim 20, wherein the second step comprises application to the pairs of sustain electrodes of such voltages of positive polarity and of negative polarity that make an effective voltage capable of generating a discharge.

24. The method according to claim 23, wherein the voltage of positive polarity is a step-wave voltage pulse whose crest value increases stepwise.

25. The method according to claim 23, wherein the voltage of positive polarity is a voltage pulse of gently curved waveform whose crest value increases gradually.

26. The method according to claim 20, wherein the second step comprises application to one of the pair of sustain electrodes of a voltage about twice as high as the sustain voltage.

27. The method according to claim 20, further comprising, after the second step, a third step of reducing the potentials of the pairs of sustain electrodes to zero to generate an self-erase discharge in the OFF-state discharge cell and, before the self-erase discharge finishes, applying to one of the pair of sustain electrodes a voltage for producing the wall charge thereby to stop the self-erase discharge and re-produce the wall charge.

28. The method according to claim 27, wherein, after the voltage for producing the wall charge is applied in the third step, the voltage is gradually reduced.

29. The method according to claim 23, wherein, in the second step, only the voltage of positive polarity is gradually reduced to zero after being applied.

30. The method according to claim 23, wherein, in the second step, only the voltage of negative polarity is gradually reduced to zero after being applied.

31. The method according to claim 23, wherein, in the second step, the voltages of positive polarity and of negative polarity are gradually reduced to zero after being applied.

32. The method according to claim 20, wherein, in the address step, a voltage is applied to one of the pair of sustain electrodes which is used as a scan electrode, the voltage having a polarity opposite to that of the wall charge produced in the address preparation step, thereby to prevent a discharge in a half-selected cell.

* * * * *